US006289964B1

(12) United States Patent
Colson et al.

(10) Patent No.: US 6,289,964 B1
(45) Date of Patent: Sep. 18, 2001

(54) CONTROL AND SUSPENSION SYSTEM FOR A COVERING FOR ARCHITECTURAL OPENINGS

(75) Inventors: Wendell B. Colson, Weston, MA (US); Brian M. Hoffmann, Louisville, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

(21) Appl. No.: 09/338,332

(22) Filed: Jun. 22, 1999

Related U.S. Application Data

(60) Provisional application No. 60/090,278, filed on Jun. 22, 1998, and provisional application No. 60/041,791, filed on Apr. 2, 1997.

(51) Int. Cl.[7] ..... E06B 9/00

(52) U.S. Cl. ..... 160/121.1; 160/178.1 R; 160/321

(58) Field of Search ..... 160/121.1, 168.1 R, 160/173 R, 178.1 R, 171, 170, 238, 267, 291, 293.1, 295, 300, 321

(56) References Cited

U.S. PATENT DOCUMENTS

| | | | |
|---|---|---|---|
| 936,387 | 10/1909 | Tripp | 160/321 |
| 1,691,463 | 11/1928 | Brewer | 160/321 |

(List continued on next page.)

FOREIGN PATENT DOCUMENTS

| | | |
|---|---|---|
| 478075 | 8/1973 | (AU) . |
| 1853139 | 6/1962 | (DE) . |
| 1245064 | 4/1966 | (DE) . |
| 1529297 | 8/1966 | (DE) . |
| 1250098 | 9/1967 | (DE) . |
| 6753201 | 4/1969 | (DE) . |

(List continued on next page.)

*Primary Examiner*—Bruce A. Lev
(74) *Attorney, Agent, or Firm*—Dorsey & Whitney LLP

(57) ABSTRACT

A control and suspension system for a retractable covering mounted on a rotating element includes an apparatus for mechanically limiting over-extensions of the covering and an apparatus for mechanically limiting over-retractions of the covering. The apparatus for limiting over-retraction includes a threaded shaft and an internal, roll-bar-support wheel treaded on the threaded shaft. An intercepting ledge comprising part of the internal, roll-bar-support wheel, and a stopping ledge comprising part of the threaded shaft. Over retraction of the covering is prohibited when the intercepting ledge impacts the stopping ledge. The apparatus for limiting over-extension includes a roll-bar-end support wheel having a down limit stop pivotally mounted thereto. When the covering material is fully extended, the limit stop rotates away from the roll-bar-end support wheel and impacts a substantially annular channel wall associated with an end cap, thereby preventing further rotation of the roll bar and thus further extension of the covering. The control and suspension system also includes an apparatus to compensate for any undesirable skewing of the covering that might occur. The skew adjustment apparatus includes a skew adjustment plate that is slidably mounted in channels on an end cap. A threaded skew adjustment plug is threadingly engaged with the skew adjustment plate such that rotation of the skew adjustment plug moves the skew adjustment plate. Finally, the control and suspension system also includes a bottom rail that attaches to the bottom of the covering by trapping a portion of the covering between a compression plate and a bottom plate.

26 Claims, 14 Drawing Sheets

U.S. PATENT DOCUMENTS

| | | | | |
|---|---|---|---|---|
| 1,725,285 | | 8/1929 | Lalonde . | |
| 1,806,228 | | 5/1931 | Ward . | |
| 2,020,595 | | 11/1935 | Weber . | |
| 2,165,492 | | 7/1939 | Lorentzen . | |
| 2,183,289 | | 12/1939 | Haase . | |
| 2,209,146 | | 7/1940 | Bessette . | |
| 2,332,851 | | 10/1943 | Harris . | |
| 2,391,904 | | 1/1946 | Junkunc . | |
| 3,595,511 | | 7/1971 | Summerville, Jr. | 248/267 |
| 3,878,878 | | 4/1975 | Reeder . | |
| 4,372,432 | | 2/1983 | Waine et al. | 160/321 |
| 4,482,137 | | 11/1984 | Gavagan et al. . | |
| 4,807,686 | | 2/1989 | Schnebly et al. . | |
| 4,909,298 | | 3/1990 | Langhart et al. . | |
| 5,044,417 | | 9/1991 | Bresson . | |
| 5,092,389 | | 3/1992 | Tedeschi | 160/321 |
| 5,184,660 | * | 2/1993 | Jelic | 160/171 |
| 5,313,999 | | 5/1994 | Colson et al. . | |
| 5,320,154 | * | 6/1994 | Colson et al. | 160/121.1 |
| 5,361,822 | | 11/1994 | Nijs . | |
| 5,375,643 | | 12/1994 | Rude | 160/321 |
| 5,485,875 | | 1/1996 | Genova . | |
| 5,518,057 | | 5/1996 | Huang . | |
| 5,577,543 | | 11/1996 | Jelic . | |
| 5,692,550 | | 12/1997 | Ford et al. . | |
| 5,791,393 | | 8/1998 | Judkins | 160/321 |
| 5,855,235 | * | 1/1999 | Colson et al. | 160/121.1 |
| 5,927,370 | * | 7/1999 | Judkins | 160/291 |
| 6,032,716 | * | 3/2000 | Mattey | 160/321 X |

FOREIGN PATENT DOCUMENTS

| | | | |
|---|---|---|---|
| 2166229 | 6/1973 | (DE) . | |
| 3032003 | 4/1982 | (DE) . | |
| 19509940 | 9/1996 | (DE) . | |
| 3703417 | 8/1998 | (DE) . | |
| 0282401 | 9/1988 | (EP) . | |
| 0494501 | 7/1992 | (EP) . | |
| 0705957 | 4/1996 | (EP) . | |
| 1025132 | 4/1953 | (FR) . | |
| 1359237 | 3/1964 | (FR) . | |
| 2278903 | 2/1976 | (FR) . | |
| 2278904 | 2/1976 | (FR) . | |
| 7661 | 4/1893 | (GB) | 160/321 |
| 1046268 | 10/1966 | (GB) . | |
| 1582862 | 1/1981 | (GB) . | |
| 59-85896 | 6/1984 | (JP) . | |
| 60-130998 | 9/1985 | (JP) . | |
| 7210880 | 2/1973 | (NL) . | |

* cited by examiner

CONTROL AND SUSPENSION SYSTEM FOR A COVERING FOR ARCHITECTURAL OPENINGS

CROSS-REFERENCE TO RELATED APPLICATIONS

The present application is related to co-pending nonprovisional application Ser. No. 09/050,507, filed Mar. 30, 1998 (the '507 application), and claiming priority to provisional application Ser. No. 60/041,791, filed Apr. 2, 1997. The '507 application is hereby incorporated by reference as though fully set forth herein. This application also claims priority to provisional application Ser. No. 60/090,278, filed Jun. 22, 1998 (the '278 application). The '278 application is hereby incorporated by reference as though fully set forth herein.

BACKGROUND OF THE INVENTION a. Field of the Invention

The instant invention is directed toward a control and suspension system for a covering for architectural openings. More specifically, it relates to hardware for suspending and controlling the operation of a panel used to cover an architectural opening.

b. Background Art

It is well known to place coverings over architectural openings. It is also well known to make these coverings retractable so that the architectural opening may be exposed or hidden as desired. A common problem with the use of such retractable coverings is ensuring that the retractable covering is not over-extended or over-retracted. For example, if an architectural covering that is mounted on a roll bar is over-extended, it may detach from the roll bar. This type of detachment is highly undesirable and may damage the architectural covering permanently. If a window covering that is mounted on a roll bar is over-retracted, that is also highly undesirable. For example, if the covering is over-retracted, it may jam in the head rail, making the architectural covering unusable. Another common problem that occurs with retractable coverings is skewing of the covering as it is retracted. For example, if the architectural covering is mounted on a roll bar, it may wind onto the roll bar unevenly or unwind from the roll bar unevenly for a variety of reasons. Such uneven winding or unwinding is known as skewing. Skewing may result from a manufacturing defect, an error in hanging the retractable covering in proximity to the architectural opening, wear on the hardware and support system, or a variety of other reasons.

Various suspension and control systems have been proposed heretofore to address these common problems with retractable coverings for architectural openings. There remains, however, a need for more efficient means of compensating for the above types of problems encountered during the use of retractable coverings for architectural openings.

SUMMARY OF THE INVENTION

It is desirable to have a control and suspension system for retractable coverings or barriers that avoids over-extensions and over-retractions of the retractable covering. It is also desirable that the control system be able to compensate for any undesirable skewing that might occur. Accordingly, it is an object of the disclosed invention to provide an improved control and suspension system for retractable coverings.

A more detailed explanation of the invention is provided in the following description and claims, and is illustrated in the accompanying drawings.

DESCRIPTION OF THE PREFERRED EMBODIMENTS

Figure 1:
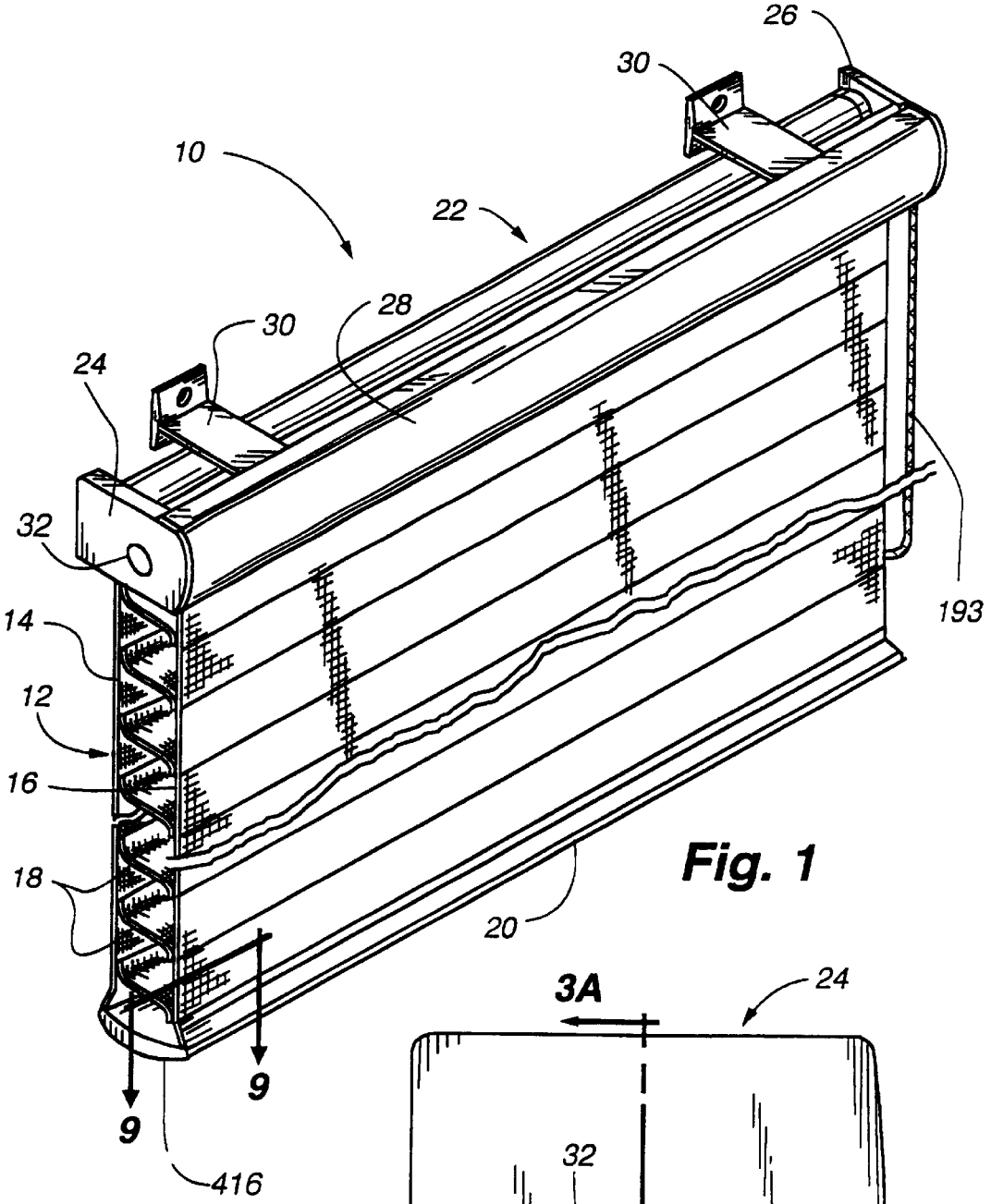
FIG. 1 is an isometric view in partial section of a retractable covering for an architectural opening in an extended configuration.

The present invention relates most directly to devices 10 for covering architectural openings and control systems for retractable coverings or barriers for architectural openings. A sample of the type of covering contemplated for use with the disclosed control system is depicted in FIG. 1. In this figure, the covering 12 comprises a first flexible sheet 14, a second flexible sheet 16, and substantially horizontal vanes 18 attached between the first and second sheets. A bottom rail 20 is attached to the first and second flexible sheets in a manner more fully discussed below. The upper end (as depicted) of the covering is attached to a roll bar, which is not visible in FIG. 1. The control system hardware responsible for limiting the travel of the covering (i.e., the hardware that sets the fully extended position and the fully retracted position of the covering) is incorporated into the head rail 22. The head rail 22 comprises a left end cap 24 and a right end cap 26, and includes an arcuate cover plate 28. The head rail 22 is attached to a support structure (e.g., a wall) by a pair of mounting brackets 30.

Figure 2:
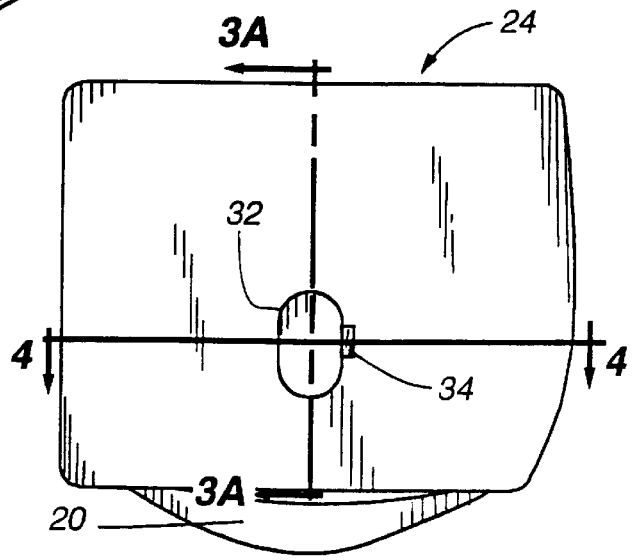
FIG. 2 is a left-end view of the retractable covering depicted in FIG. 1 with the covering in a fully retracted configuration.

FIG. 2 is an enlarged view of a portion of the left end of the apparatus 10 for covering an architectural opening. In this view an access door 32 through which the system components that control the fully retracted position is clearly visible. A slot 34 is formed into the left end cap 24. In order to gain access to the control system hardware inside the head rail 22, the access door 32 depicted in FIG. 2 is first removed by using a flat blade screwdriver, for example, into the door removal slot 34 molded into the left end cap 24 and prying the access door 32 from the door support ledge 44 (see FIG. 5A). Once the desired adjustments have been made, the access door 32 may be popped or snapped back into position in the left end cap 24 to restore a more aesthetically pleasing appearance to the head rail 22. Also, as depicted in FIG. 2, the covering 12 is fully retracted such that the bottom rail 20 is adjacent to the bottom side of the end caps 24, 26.

Figure 3A:
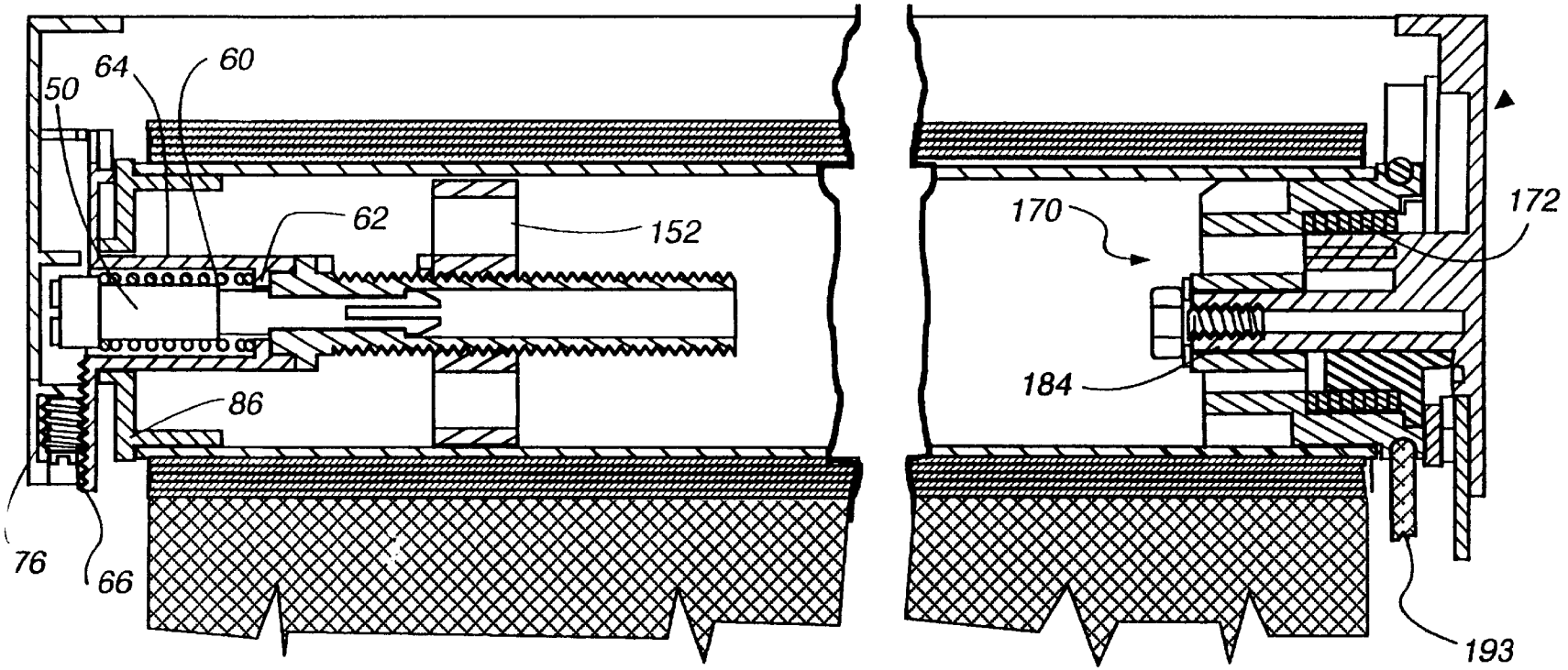
FIG. 3A is a fragmentary sectional view taken about line 3A—3A of FIG. 2, depicting control system hardware.
Figure 3B:
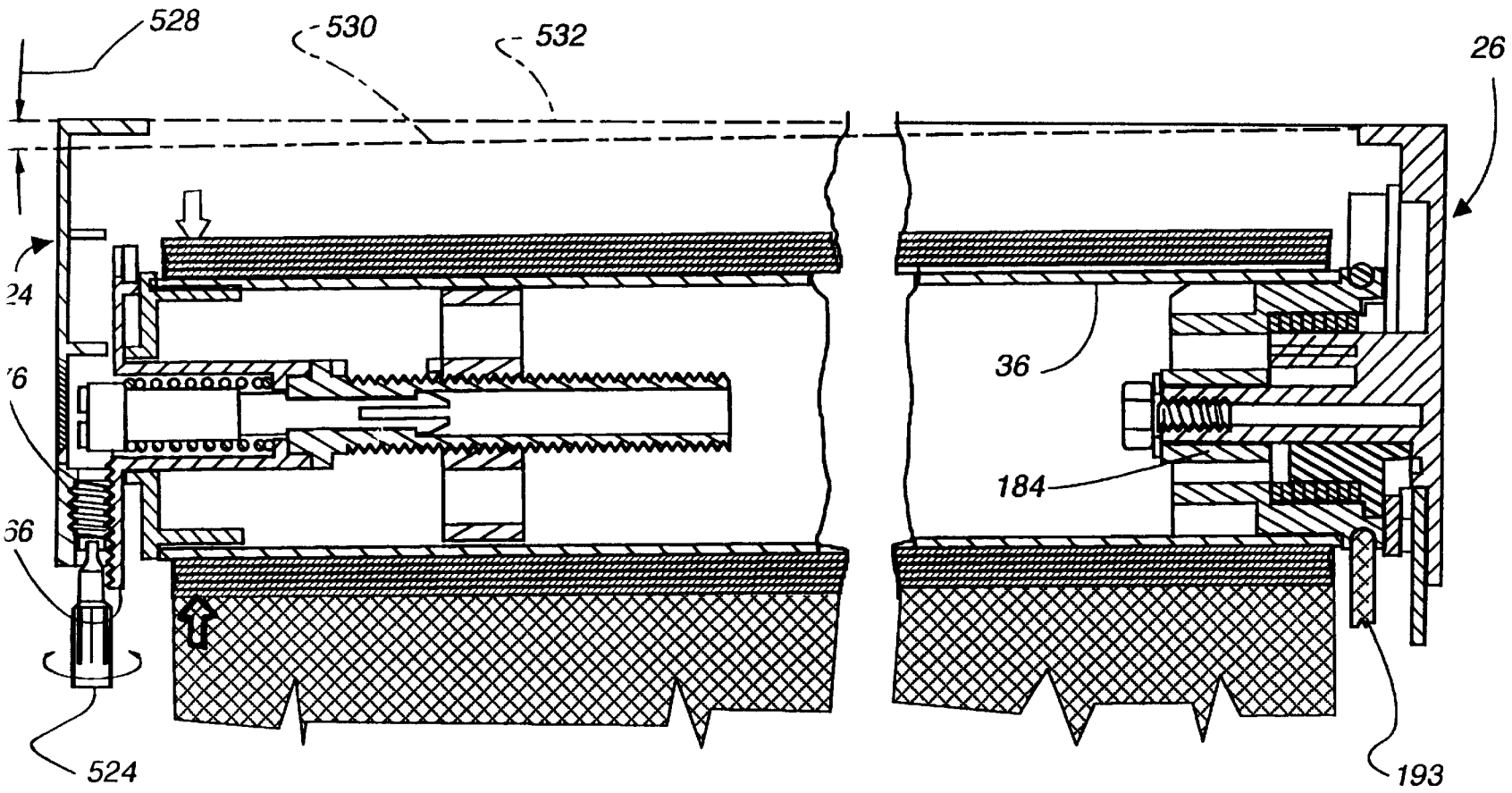
FIG. 3B is a fragmentary view of the covering depicted in FIG. 3A, depicting skew compensation.
Figure 4:
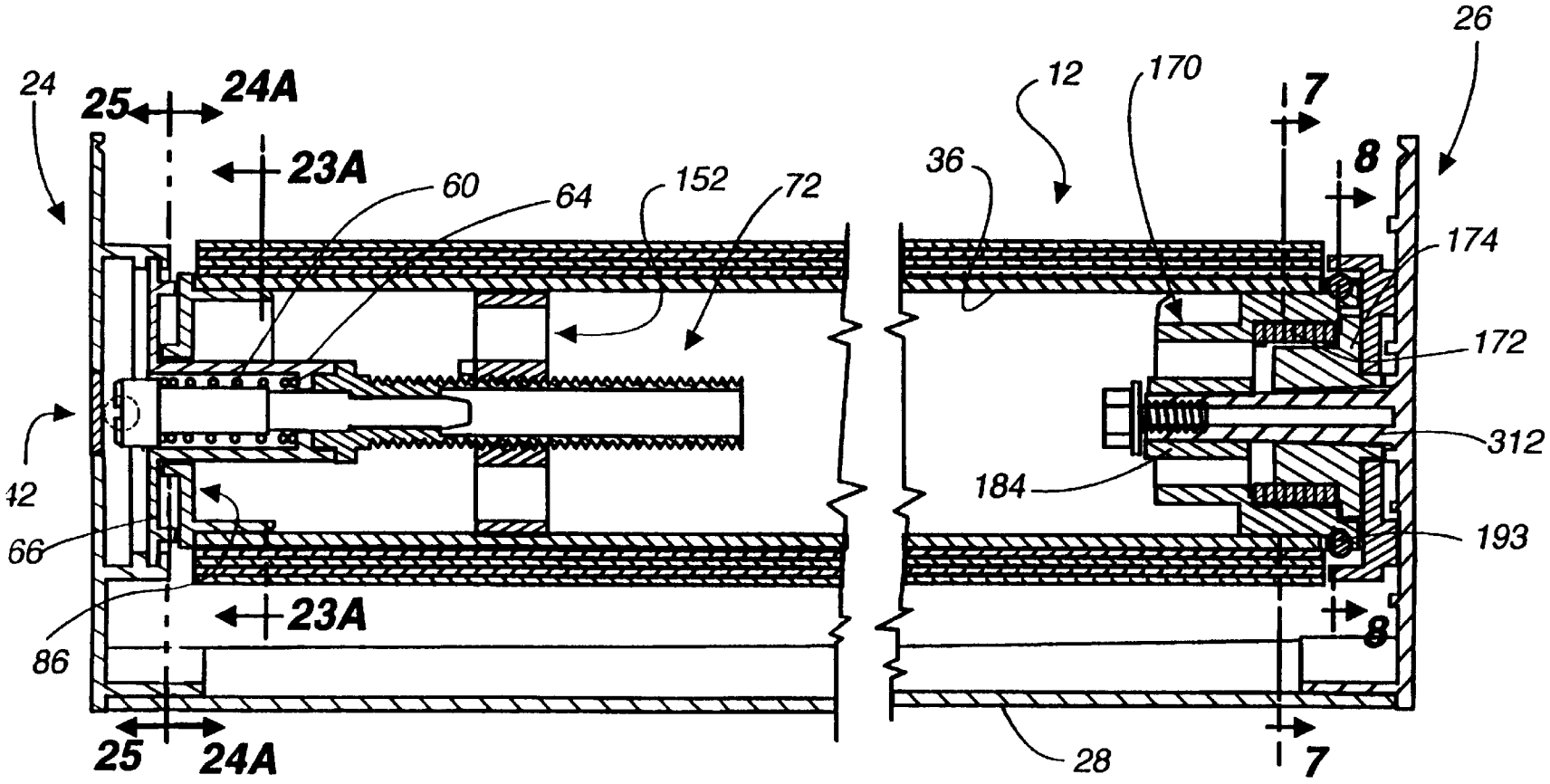
FIG. 4 is a downward fragmentary cross-sectional view taken about line 4—4 of FIG. 2, depicting control system hardware.

FIGS. 3A, 3B, and 4 depict fragmentary cross-sectional views of the head rail 22 taken along two perpendicular planes passing through the longitudinal axis of rotation of the roll bar 36. In particular, FIGS. 3A and 3B show a partial cross-sectional view of the head rail 22 taken along line 3A—3A of FIG. 2. These views are taken along a vertical plane that passes through the longitudinal axis of rotation of the roll bar 36 incorporated in the head rail 22. FIG. 4, on the other hand, is a fragmentary cross-sectional view taken along the plane containing line 4—4 of FIG. 2, which passes horizontally through the longitudinal axis of rotation of the roll bar 36 mounted in the head rail 22 depicted in FIG. 1. The left end, as depicted, of these three figures show details concerning the skew adjustment features of the invention, and details concerning the system components that permit adjustment of an upper stop limit (i.e., the components that control how far the covering may be retracted). The right-hand end, as depicted in FIGS. 3A, 3B, and 4, show components of the control system that control retraction and extension of the covering via a clutch mechanism. The clutch mechanism used in the present invention is closely related to the clutch mechanism described in co-pending application Ser. No. 09/050,507, which has been incorporated herein by reference as though fully set forth in the present application. The reader should refer to this related application for details concerning the break away cord system used in the right-hand end of the head rail 22 of the present invention.

Figure 5A:
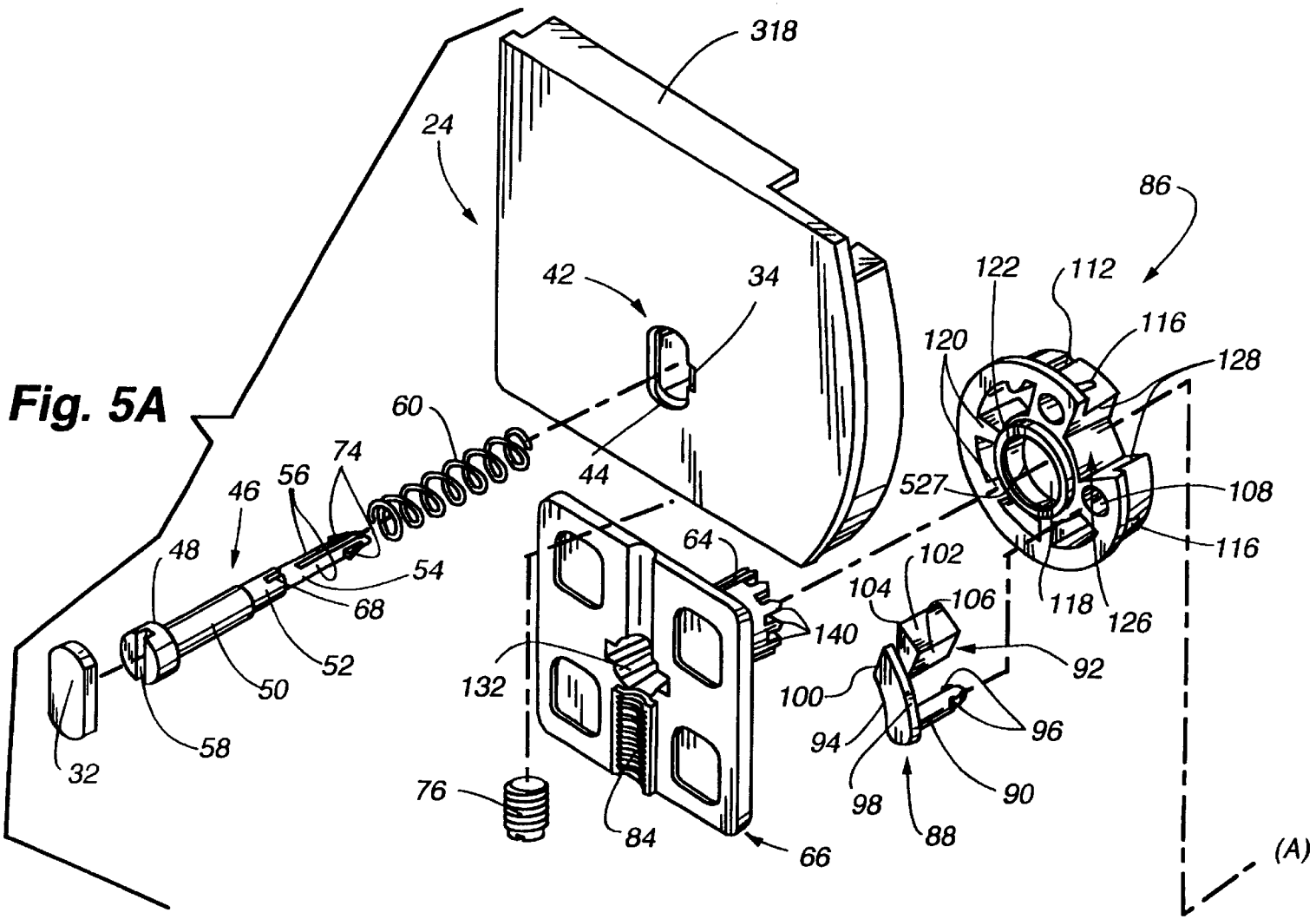
FIGS. 5A, 5B, and 5C together depict an exploded isometric view of control system hardware located at each end of the head rail.
Figure 5B:
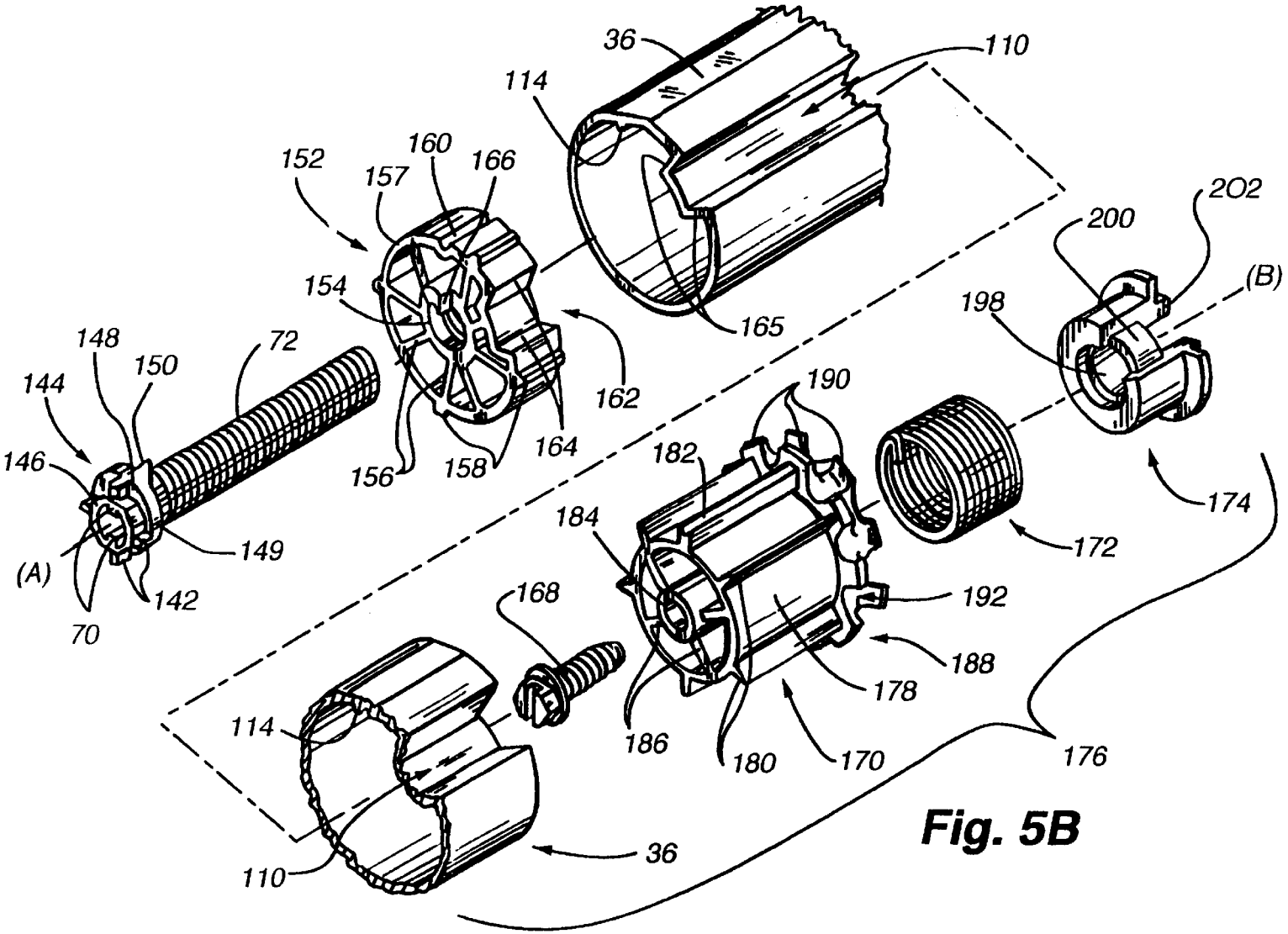
Figure 5C:
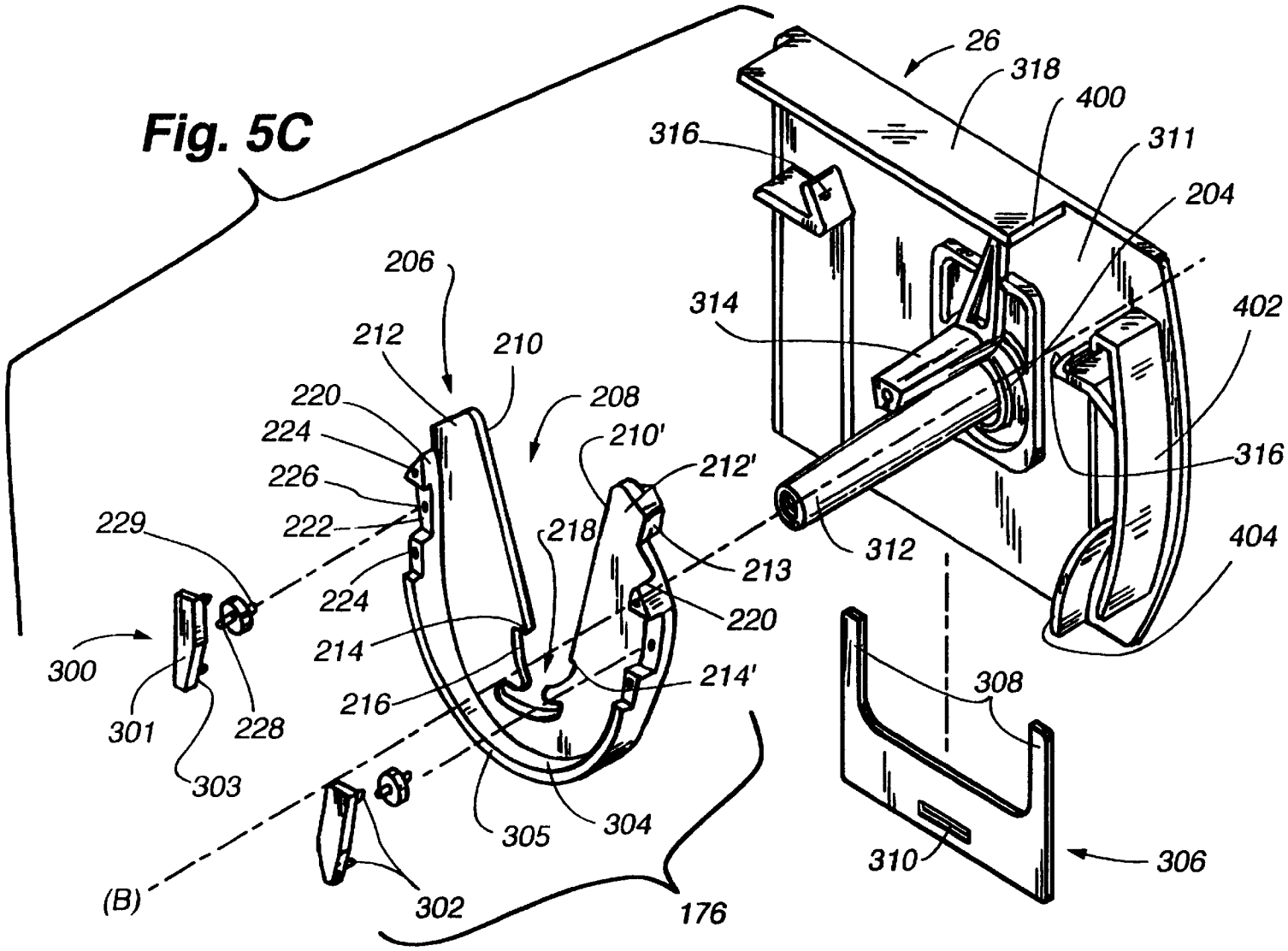

FIGS. 5A, 5B, and 5C together depict the major components of the control system 10 comprising part of the head rail 22 of the present invention. These three figures together comprise an exploded perspective view of components comprising the control system. Referring first to FIG. 5A and the top half of FIG. 5B, the components associated with the left end, as depicted, of the head rail 22 are described first. Depicted at the left-hand edge of FIG. 5A is the access door 32. The access door 32 covers the access port 42 in the left end cap 24. When in position, the circumferential edge of the access door rides in a door support ledge 44 formed in the left end cap 24. Also formed in the left end cap 24 is a slot 34 that permits someone desiring to make adjustments in the head rail components to remove the access door 32. The access door 32 fits into position by pressing it into the access port 42 until it snaps or pops into position.

Moving from left to right in FIG. 5A following the dashed line, the next component encountered is the plunger 46. The plunger 46 comprises a plunger head 48 followed by a large cylindrical portion 50, an intermediate cylindrical portion 52, a small cylindrical portion 54, and two flexible arms 56. A screwdriver slot 58 is formed into the plunger head 48. The large cylindrical portion 50 has a cross-sectional diameter that accommodates a setting retention spring 60, also depicted in FIG. 5A (see, e.g., FIGS. 3A, 3B, and 4). The inside diameter of the generally cylindrical cavity within the setting retention spring 60 is slightly larger than the outside diameter of the large cylindrical portion 50 of the plunger 46. As shown in FIG. 3A, for example, the setting retention spring 60 slides over the large cylindrical portion 50 of the plunger 46 when the head rail 22 is assembled. The diameter of the intermediate cylindrical portion 52 is slightly smaller than the diameter of a spring retention ring 62 (see, e.g., FIG. 3A) located inside a cylindrical housing 64 extending longitudinally from the inward side of a skew adjustment plate 66. The spring retention ring 62 is an integral part of the skew adjustment plate 66. In particular, the spring retention ring 62 is formed on the inner surface of the cylindrical housing 64 projecting from the skew adjustment plate 66. In the assembled head rail 22, the setting retention spring 60 is mounted around the large cylindrical portion 50 of the plunger 46 and is trapped between the underside of the plunger head 48 and the spring retention ring 62 of the cylindrical housing 64 that is part of the skew adjustment plate 66.

As shown in FIG. 5A, the intermediate cylindrical portion 52 of the plunger 46 includes two interlocking channels 68, which are offset from each other by approximately 180° in the preferred embodiment. As will be described further below, these interlocking channels receive interlocking tabs 70 of a threaded shaft 72 (see FIG. 5B). Locking tabs 74 are located at the distal ends of the two flexible arms 56 of the plunger 46. As explained in more detail below, these locking tabs 74 help ensure that the plunger 46 and the threaded shaft 72 in the assembled head rail 22 move as a single unit.

Figure 6B:
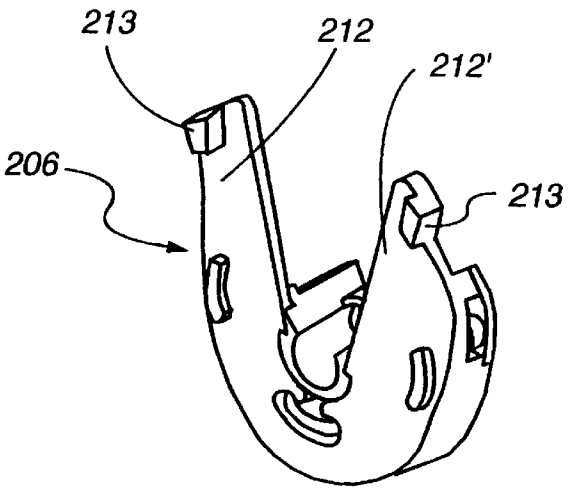
FIG. 6B is an isometric view of the releasable mounting plate, the other side of which is depicted in FIG. 5C.
Figure 6A:
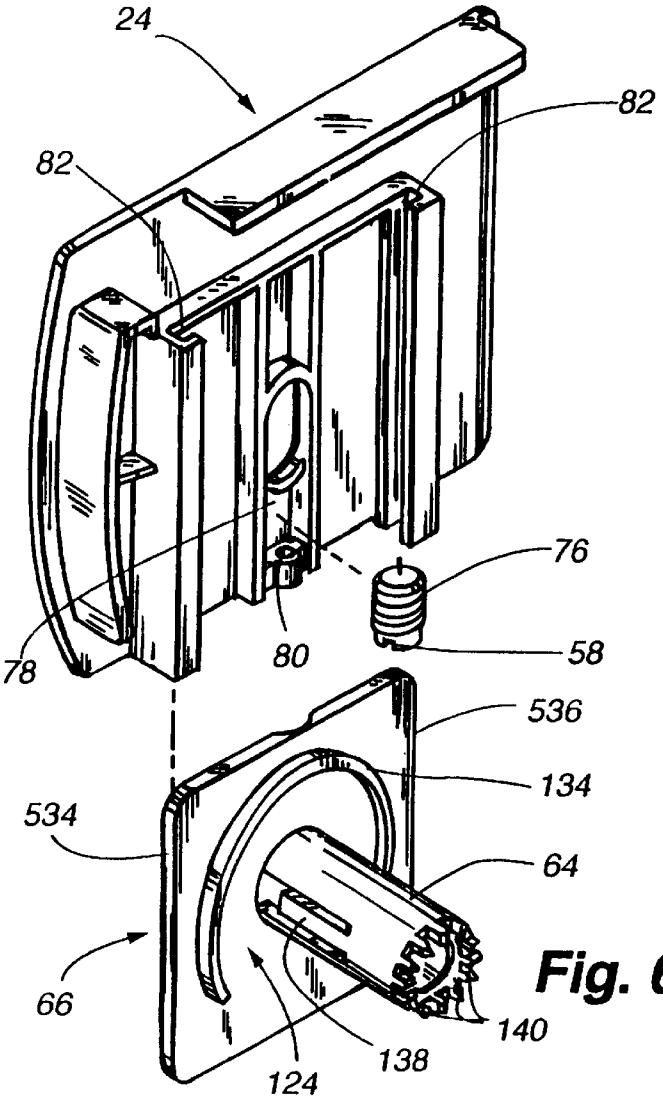
FIG. 6A is an isometric view of hardware also depicted in FIG. 5A, but from the opposite direction.

Continuing from left to right in FIG. 5A, the next components of interest are the skew adjustment plate 66 and a threaded skew adjustment plug 76. The cooperation or relationship between the left end cap 24, the threaded skew adjustment plug 76, and the skew adjustment plate 66 is best seen by considering FIG. 5A in conjunction with FIG. 6A and FIG. 3B. As best seen in FIG. 6A, the left end cap has molded on its inner surface a plug bed 78. The threaded skew adjustment plug 76 rides in the plug bed such that the screwdriver slot 58 in the bottom end of the skew adjustment plug 76 is accessible through an access hole 80, which is also molded on the inner surface of the left end cap 24. When the skew adjustment plate 66, which also mounts the roll bar 36, is positioned in a pair of the channels 82 located on the back side of the left end cap 24, the threaded skew adjustment plug 76 is pinched between the bottom of the plug bed 78 (FIG. 6A) and an arcuate threaded surface 84 (FIG. 5A) on the left-hand side, as depicted, of the skew adjustment plate 66. The skew adjustment plug 76 is thereby trapped in the plug bed 78 between the left end cap 24 and the skew adjustment plate 66. The pressure exerted on the threaded skew adjustment plug 76 by the left end cap 24 and the skew adjustment plate 66 prevents the skew adjustment plug 76 from easily rotating, but it remains possible to rotate the skew adjustment plug 76 using a flat-blade screwdriver inserted through the access hole 80 molded in the left end plate 24 as depicted in FIG. 3B.

Referring again to FIG. 5A, a roll-bar-end support wheel 86 and its associated down limit stop 88 are described next. As depicted, the down limit stop comprises three primary components: a mounting tang 90, a wedge 92, and an arcuate arm 94. As depicted, the distal end of the mounting tang 90 is split, and a locking tab 96 is integrally formed on opposing sides of the mounting tang 90 adjacent to the split. The opposite end of the mounting tang 90 is integrally formed with one end of the arcuate arm 94. The arcuate arm 94 includes an arcuate outer edge 98 and a substantially flat leading edge 100. The wedge 92 is attached to the same side of the arcuate arm 94 as the mounting tang 90, but the wedge 92 is attached adjacent, but not flush with, the leading edge 100 of the arcuate arm 94, whereas the mounting tang 90 is integrally formed with the opposite end of the arcuate arm 94. The wedge 92 includes an outer surface 102, a leading edge 104, and a trailing edge 106.

The roll-bar-end support wheel 86 includes a mounting hole 108 that accommodates the mounting tang 90 of the down limit stop 88. When the mounting tang 90 is properly inserted into the mounting hole 108, the locking tabs 96 on the distal end of the mounting tang 90 rotatably lock the down limit stop 88 to the roll-bar-end support wheel 86. Since the diameter of the mounting hole 108 substantially corresponds to the diameter of the mounting tang 90, the locking tabs 96 snap outward once they pass an annular ledge 526 inside the mounting hole 108 (see FIG. 24C). The portion of the mounting tang 90 between the back side of the arcuate arm 94 and the bottom of the slot existing in the distal end of the mounting tang 90 substantially corresponds to the length of the mounting hole 108 in the roll-bar-end support wheel 86. When the down limit stop 88 is thus snapped into position onto the roll-bar-end support wheel 86, and after the roll-bar-end support wheel 86 is positioned in the roll bar 36 (see FIG. 22), the wedge 92 of the down limit stop 88 rides in an elongated channel 110 (FIG. 5B) of the roll bar 36.

The roll-bar-end support wheel 86 also includes an alignment groove 112. The alignment groove 112 accommodates an alignment tongue 114 (FIG. 5B) comprising an integral part of the roll bar 36. The alignment groove 112, when slipped over the alignment tongue 114, forces the roll-bar-end support wheel 86 to rotate in unison with the roll bar 36. Also visible in FIG. 5A on the roll-bar-end support wheel 86 are alignment ribs 116. As may be clearly seen, these alignment ribs 116 are slightly tapered to facilitate easy insertion of the roll-bar-end support wheel 86 into the end of the roll bar 36 during assembly of the apparatus 10 for covering an architectural opening. A smooth barrel 118 is supported at the center of the roll-bar-end support wheel 86 by a plurality of spokes 120. The left end of the smooth barrel 118 includes an annular bearing surface 122, which rides in a channel 124 (FIG. 6A) on the inside surface, as depicted, of the skew adjustment plate 66, adjacent the cylindrical housing 64. Also visible in FIG. 5A is a complimentary channel 126 and its side walls 128, which accommodate the elongated channel 110 (FIG. 5B) of the roll bar 36 in the assembled head rail 22.

Referring now to FIGS. 5A and 6A, additional details concerning the skew adjustment plate 66 are provided. The left-hand side of the skew adjustment plate 66, as depicted, includes the arcuate threaded surface 84 previously described. The cylindrical housing 64 projects from the right side of the skew adjustment plate 66 and is integrally molded in the preferred embodiment with the skew adjustment plate 66. A bore 132 passes completely through the skew adjustment plate 66 and the center of the cylindrical housing 64. Referring in particular to FIG. 6A, the right side, as depicted, of the skew adjustment plate 66 includes a substantially annular channel wall 134 defining the substantially annular channel 124. Two support wheel locks 138 are arranged on the surface of the cylindrical housing 64. When the roll-bar-end support wheel 86 is slid into position over the cylindrical housing 64 and is fully seated so that the annular bearing surface 122 of the roll-bar-end support wheel 86 is against the skew adjustment plate 66, the support wheel locks 138, which are located approximately 180° apart on the surface of the cylindrical housing 64, snap over the annular ledge 527 visible in FIGS. 5A and 24C to rotatably lock the roll-bar-end support wheel 86 into position. When the roll-bar-end support wheel 86 is thus positioned over the cylindrical housing 64, the arcuate arm 94 of the down limit stop 88 rides in the substantially annular channel 124 visible in FIG. 6A. The arcuate arm 94 riding in this channel 124 is also clearly depicted in FIG. 24A. Locking fingers 140 are molded into the distal end of the cylindrical housing 64 (FIG. 6A). When the head rail 22 is fully assembled as depicted in FIGS. 3A, 3B, and 4, for example, the locking fingers 140 are engaged by the four locking lugs 142 depicted on the left end in FIG. 5B.

Referring now to FIG. 5B, the components of the threaded shaft 72 are described next. In the preferred embodiment, the threads on the threaded shaft are left-handed threads. The left end, as depicted, of the threaded shaft 72 comprises a head 144. On the interior of the head 144 are the two short interlocking tabs 70, which engage the interlocking channels 68 on the plunger 46 (see FIG. 5A) after the head rail 22 is assembled. Moving outward radially from the interlocking tabs, an annular abutment surface 146 is next encountered. As may be seen, for example, in FIG. 17, this annular abutment surface rides against the inward side of the spring retention ring 62. Moving further out radially on the left-hand end, as depicted in FIG. 5B, of the threaded shaft 72, the four locking lugs 142 are next present. These four locking lugs 142, which are positioned at substantially 90° intervals around the circumference of the annular abutment surface 146, engage the locking fingers 140 of the cylindrical housing 64 to facilitate adjustment of the maximum amount of retraction of the covering 12 that is possible. The four locking lugs 142 project leftward, in FIG. 5B, from a finger seat 148, which is annular in configuration. The reader is referred, for example, to FIG. 19, which shows the locking fingers 140 of the cylindrical housing 64 resting against the finger seat 148 located on the head 144 of the threaded shaft 72 when the head rail 22 is assembled and is not being adjusted. Finally, on the back side, as depicted in FIG. 5B, of the head 144 of the threaded shaft 72 is a stopping ledge 150. The function of the stopping ledge 150, which may also be clearly seen in FIGS. 18 and 19, will be described in further detail below.

Referring again to FIG. 5B, the next component encountered is the internal, roll-bar-support wheel 152. This internal, roll-bar-support wheel 152 may also be seen in at least FIGS. 3A, 3B, 4, and 22. The internal, roll-bar-support wheel 152 includes an internally threaded barrel 154. This threaded barrel 154 makes it possible to thread the internal, roll-bar-support wheel 152 onto the threaded shaft 72 adjacent the wheel 152 in FIG. 5B. The threaded barrel 72 is supported by a plurality of barrel support spokes 156 which extend radially between the outer surface of the threaded barrel 154 and the outer ring 157 of the internal, roll-bar-support wheel 152. The outer ring 157 of this wheel 152 is not completely rounded. In particular, contact ribs 158 are present on the outer surface of the outer ring 157. When the internal, roll-bar-support wheel 152 is inserted into the roll bar 36, these contact ribs 158 ride on the inner surface of the roll bar 36 and help ensure that the alignment of the internal, roll-bar-support wheel 152 is correct. Also present on the outer surface of the outer ring 157 is an alignment groove 160. The alignment groove 160 accommodates the alignment tongue 114 running down the inside of the roll bar 36 parallel to the longitudinal axis of the roll bar 36. When the internal, roll-bar-support wheel 152 is properly inserted into the interior of the roll bar 36, the alignment tongue 114 rides in the alignment groove 160, which helps ensure that the internal, roll-bar-support wheel 152 and the roll bar 36 rotate in unison. The outer ring 157 of the internal, roll-bar-support wheel 152 also includes a complimentary channel 162 and side walls 164, which accommodate a similar elongated channel 110 and its corresponding channel side walls 165 formed integrally with the roll bar 36. Thus, when the internal, roll-bar-support wheel 152 is properly inserted into the interior of the roll bar 36, the alignment tongue 114 is trapped within the alignment groove 160, and the elongated channel 110 of the roll bar is similarly captured in the complimentary channel 162 in the internal roll-bar-support wheel 152. Also visible on the internal roll-bar-support wheel 152 depicted in FIG. 5B is an intercepting ledge 166. If the internal, roll-bar-support wheel 152 is threaded far enough onto the threaded shaft 72, the intercepting ledge 166 of the roll-bar-support wheel 152 will impact on the stopping ledge 150 of the threaded shaft 72. This interaction is described further below with reference to FIGS. 18 and 19.

Next, depicted in the upper half of FIG. 5B and in the lower leftmost portion of FIG. 5B are fragmentary portions of the roll bar 36. The primary features of the roll bar 36, including the alignment tongue 114 and the elongated channel 110 have been described previously.

The remaining components depicted in FIG. 5B (namely the screw 168, drive member 170, clutch coil spring 172, and mounting hub 174) cooperate with several components depicted in FIG. 5C to rotatably support the right-hand end, as depicted, of the roll bar 36. These components include a break away operating cord system 176 substantially identical to that described in co-pending applications Ser. No. 09/050,507, filed Mar. 30, 1998, which disclosure is incorporated in the present application as though fully set forth herein. The reader is referred to that prior application for further details concerning the construction and operation of the break away cord mechanism in addition to the disclosure provided in the present application. The drive member 170 (FIG. 5B) includes a generally cylindrical main body 178 having a plurality of generally radial support ribs 180 projecting from an outer surface of the cylindrical main body 178. One of the support ribs includes an alignment groove 182, which is similar to the alignment groove 160 previously described in connection with the internal, roll-bar-support wheel 152. When the drive member 170 is inserted into the right end, as depicted, of the roll bar 36 and is properly aligned, the alignment tongue 114, which is an integral part of the internal surface of the roll bar 36, rides in the alignment groove 182, thereby forcing the drive member 170 and roll bar 36 to rotate in unison. A tapered barrel 184 is suspended by a plurality of barrel support spokes 186 extending between the exterior surface of the tapered barrel 184 and the internal surface of the generally cylindrical main body 178 of the drive member 170. At the right-hand end, as depicted, of the drive member 170 is a drive wheel 188. The drive wheel 188 includes alternate radially extending teeth 190, which define a channel 192 between them. As shown in other figures (e.g., FIG. 8), the channel 192 accommodates an operating cord 193.

The tapered barrel 184 suspended in the center of the generally cylindrical main body 178 does not extend the full length of the inside of the generally cylindrical main body 178. Rather, as is clearly depicted in FIGS. 3A, 3B, and 4, for example, the tapered barrel 184 extends only approximately half way through the generally cylindrical main body 178. Subsequently, the inside of the generally cylindrical main body 178 becomes larger. The diameter of this larger portion of the internal surface of the generally cylindrical main body 178 is designed to accommodate the clutch coil spring 172 depicted in FIG. 5B. The internal surface of the generally cylindrical main body 178 is merely notched a sufficient amount to accommodate the clutch coil spring 172. When the clutch coil spring 172 is properly installed, the internal surface of the spring 172 is substantially coplanar with the internal surface of the generally cylindrical main body.

A mounting hub 174 is the final component visible in FIG. 5B. The mounting hub 174 has a central cylindrical axial passage 198 and includes a generally U-shaped longitudinally extending channel 200. On the right-hand end, as depicted, of the mounting hub 174 is a bearing surface 202. This bearing surface is substantially annular and rides on the inner ring-like bearing surface 204 (FIG. 5C) located on the inward side of the relatively flat base of the right end cap 26 when the head rail 22 is fully assembled.

Even though FIG. 5B shows only one clutch spring 172 in the preferred embodiment there are two clutch springs placed back-to-back in the drive member 170.

Referring now to FIG. 5C, additional components of the right end of the head rail 22 are depicted. First, a releasable mounting plate 206 is shown. This releasable mounting plate 206 includes a generally U-shaped notch 208. This generally U-shaped notch 208 is defined by side edges 210, 210' that extend from the distal end of a pair of clamp arms 212, 212' toward a pair of horizontal lips 214, 214' and then around an arcuate segment 216 defining an enlarged recess area 218. This enlarged recess area 218 and the horizontal lips 214, 214', conform to the shape molded into the rear side, as depicted, of the mounting hub 196 (see FIG. 6B, which shows the rear side of the mounting hub 174). The releasable mounting plate 206 also includes a pair of mounting blocks 220 on the peripheral edges of each clamp arm 212, 212'. These mounting blocks 220 each define a pulley channel 222 that is substantially U-shaped. A pin hole 224 is located on the legs of the pulley channel and a shaft hole 226 is located in the base of the pulley channel 222. During assembly, a pulley wheel 228 is mounted in each pulley channel 222 by inserting the shaft 229 of the pulley wheel 228 into the shaft hole 226 of the pulley channel 222. Then, the operating cord 193 (FIG. 8) is threaded above the pulley wheel 228 between the upper portion of the mounting block 220 and the top of the pulley wheel 228. Then, the pulley plate 300, which comprises a pair of mounting pins 302 on its back side 303 and includes a shaft hole on its back side (not depicted) is positioned to rotatably secure the pulley wheel 228 in position in the pulley channel 222. When the pulley plate 300 is properly positioned over the mounting block 220, the top side 301 of the pulley plate is substantially coplanar with the top surface 305 of the semi-circular guide plate 304.

The lock plate 306 depicted in FIG. 5C may be used to disable the break-away feature of the operating cord 193. The lock plate 306 is slid into position after the other components of the break away operating cord system are assembled. When properly positioned, the upstanding legs 308 of the lock plate 306 prevent the two clamp arms 212, 212' of the releasable mounting plate 206 from permitting the releasable mounting plate 206 from releasing. Since it may be difficult to remove the lock plate 306 after it has been inserted, the lock plate 306 includes an elongated slot 310. If the lock plate 306 is difficult to remove, a flat-blade screwdriver may be inserted into the elongated slot 310 to facilitate removal of the lock plate 306.

Various details of the inner surface of the right end cap 26 are visible in FIG. 5C. Protruding from the relatively flat base 311 of the right end cap 26 is a tapered support shaft 312. This tapered support shaft 312 supports the mounting hub 174 and the drive member 170 as shown in FIG. 4, for example. Extending substantially parallel to the tapered support shaft is the stop arm 314. A pair of abutment surfaces 316 are visible on each side of the right end cap 26. These abutment surfaces 316 are impacted by the abutment surfaces 213 on the clamp arms 212, 212', one of which is visible on the releasable mounting plate depicted in FIG. 5C. Also visible in FIG. 5C is a top wall 318, which is an integral part of the right end cap 26. When the head rail 22 is fully assembled, as depicted in FIG. 1, for example, an end portion 400 of the top wall abuts a corresponding surface on the arcuate cover plate 28. The back side of the arcuate cover plate 28 is supported by the arcuate, plate-like projection 402 depicted in FIG. 5C. This arcuate, plate-like projection 402 is integrally molded as a part of the right end cap 26 in the preferred embodiment. Finally, a cord guide surface 404 is also depicted in FIG. 5C as being integrally formed on the back side or internal side, as depicted, of the right end cap 26.

Figure 8:
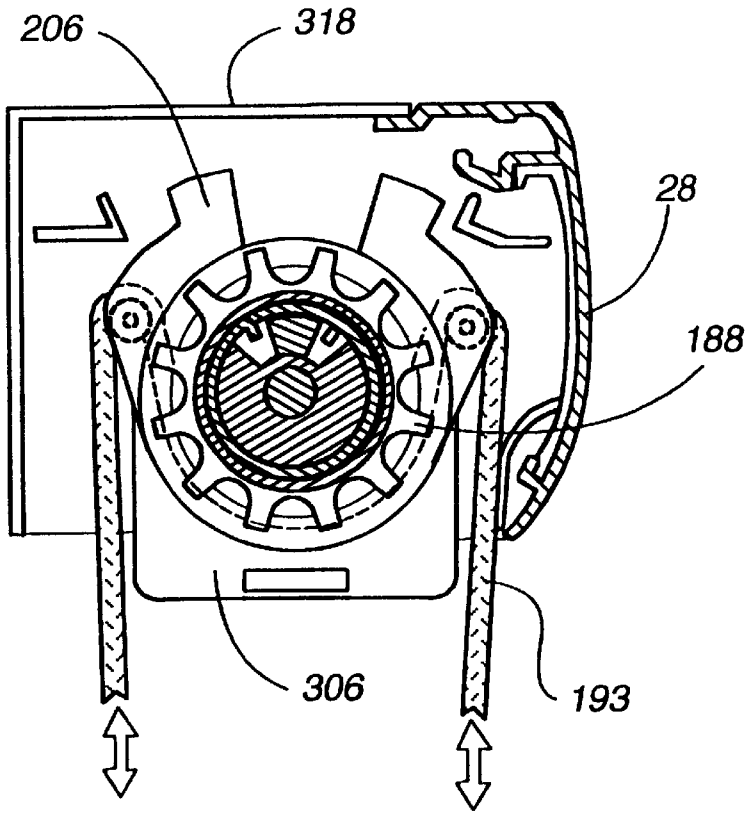
FIG. 8 is a cross-sectional view of the clutch mechanism of the control system taken about line 8—8 of FIG. 4.
Figure 7:
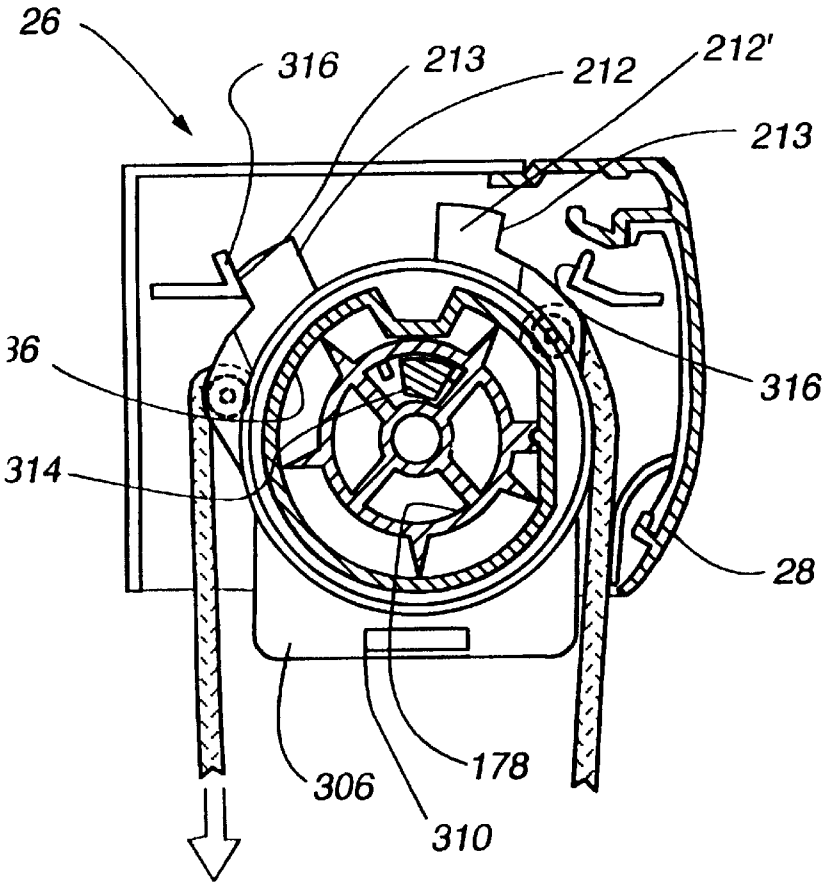
FIG. 7 is a cross-sectional view of the clutch mechanism of the control system taken about line 7—7 of FIG. 4.

When the break away clutch system is completely assembled, it appears as depicted in FIGS. 4, 7, and 8, for example. FIG. 7 depicts a cross-sectional view taken along line 7—7 of FIG. 4. Clearly visible in FIG. 7 are the abutment surfaces 213 on each of the clamp arms 212, 212' of the releasable mounting plate 206 in proximity to the corresponding abutment surfaces 316 of the right end cap 26. FIGS. 7 and 8 are included in the present application primarily for context. For additional details and explanation concerning the assembly and operation of the break away clutch mechanism, the reader is referred to co-pending application Ser. No. 09/050,507, which has been incorporated herein by reference.

Figure 10:
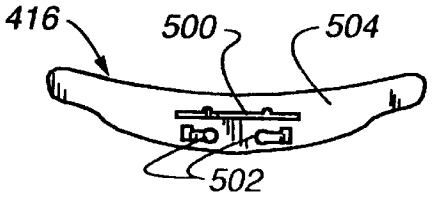
FIG. 10 is a view of the inside surface of a bottom rail end cap, depicting the projections extending from the inside surface of the bottom rail end cap.
Figure 11:
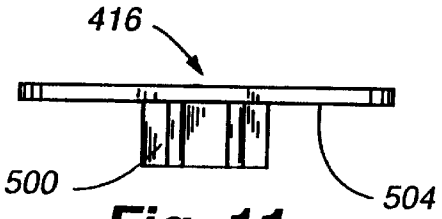
FIG. 11 is a top planform view of the bottom rail end cap depicted in FIG. 10.
Figure 9:
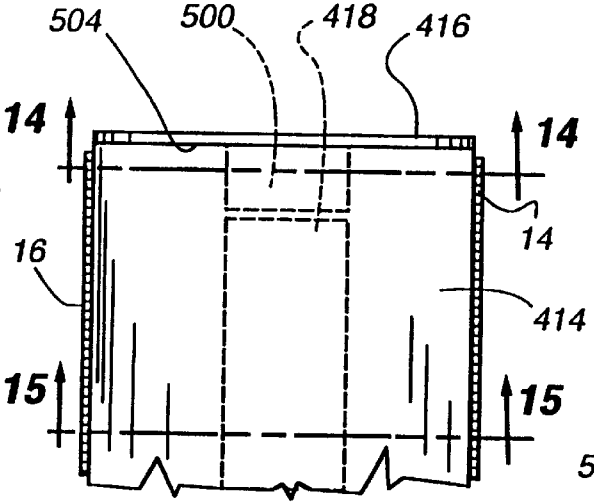
FIG. 9 is a partial sectional view of the left end of the bottom rail taken about line 9—9 of FIG. 1.

Referring now to FIGS. 9, 10, 11, 12, 13, 14, 15, and 16, the bottom rail 20 of the present invention is next discussed. The bottom rail 20, an isometric view of which is clearly shown in FIG. 1, comprises a bottom plate 412, a compression plate 414, a pair of end caps 416 and an optional weight 418. FIG. 9 is a fragmentary cross-sectional view of a portion of the bottom rail 20 taken along line 9—9 of FIG. 1. FIG. 9 depicts the relationship between the left bottom rail end cap 416, the first and second flexible sheets 14, 16, the compression plate 414, and the optional weight 418. As seen in FIGS. 9, 10, and 11, the bottom rail end caps 416 (the right end cap is not depicted but is the same as the left end cap) include an upper projection 500 and two lower projections 502 extending from the inside surface 504 of the end caps 416. The upper projection 500 is shown in phantom in FIG. 9, but additional details concerning the upper projection 500 may be clearly seen in FIGS. 10 and 11. The two lower projections 502 depicted in FIG. 10 extend in the preferred embodiment approximately the same distance from the inside surface 504 of the rail end caps 416 as does the upper projection 500. These three projections frictionally engage the compression plate 414 and the bottom plate 412 of the bottom rail 20 to removably secure the end caps 416 to the bottom rail 22.

Figure 13:
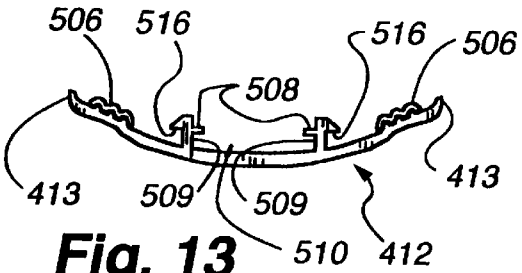
FIG. 13 is an end view of the bottom plate, which forms a portion of the bottom rail.
Figure 15:
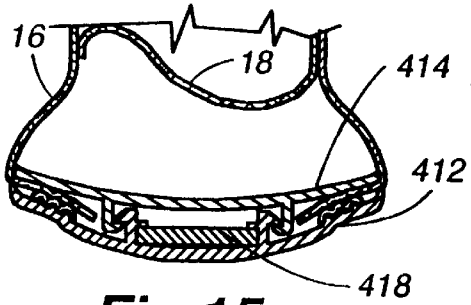
FIG. 15 is a fragmentary cross-sectional view of the bottom rail and the covering taken about line 15—15 of FIG. 9.

Referring in particular to FIG. 13, the bottom plate 412 is next described. As shown in FIG. 13, the bottom plate has a winged U-shape when viewed in cross-section perpendicular to the longitudinal axis of the bottom rail 20. Two strips of gripping material 506 extend along the interior surface of the bottom plate 412. These strips of gripping material 506 are substantially parallel to the longitudinal axis of the assembled bottom rail 20. When the first and second sheets 14, 16 arc trapped during bottom sheet assembly (see, for example, FIG. 16), the gripping material 506 helps hold the flexible sheet material in position. In the preferred embodiment, the bottom plate 412 itself is made from a plastic material, and the gripping material is a type of gummier, rubber-like material. Extending upward (leftward as depicted in FIG. 13) from the bottom plate 412 and continuing for the entire length of the bottom rail 20 in a longitudinal direction are a pair of inwardly projecting ledges 508. The ledges 508 project inwardly from a distal end of a vertical wall 509 and are substantially perpendicular to the vertical wall 509. The vertical walls 509 are attached at one end to the bottom plate 412. A weight channel 510 is defined by the substantially rectangular pocket created between the undersides of the inwardly projecting ledges 508 and the inside surface of the bottom plate 412. If the optional weight 418 were used, it is preferably placed in the weight channel 510 as shown in FIG. 15. The weight 418 may be used to help the covering 12 extend more easily, and the optional weight could also assist in anti-skew adjustment. On the opposite sides of the substantially vertical walls 509, are two other ledges 516, 516' extending toward the longitudinal edges 413 of the bottom plate 412. Each of these latter two ledges 516, 516' also extend for the entire longitudinal length of the bottom plate 412 in the preferred embodiment. Each of these latter ledges 516, 516' also interlocks with a corresponding ledge 517, 517', respectively, on the compression plate 414 to secure the bottom plate 412 to the compression plate 414.

Figure 12:
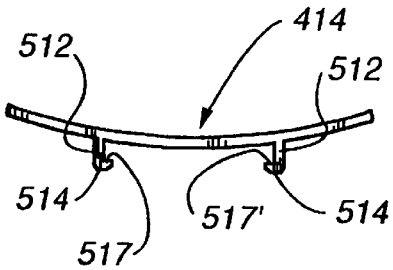
FIG. 12 is an end view of the compression plate, which forms a portion of the bottom rail.
Figure 14:
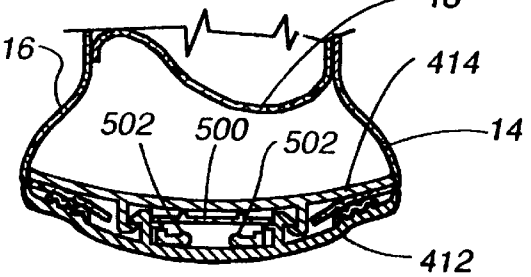
FIG. 14 is a fragmentary cross-sectional view of the bottom rail and a portion of the covering taken about line 14—14 of FIG. 9.

Referring now to FIG. 12, the compression plate 414 in the preferred embodiment has a substantially arcuate cross-section. A pair of substantially vertical walls 512 extend from the underside of the compression plate 414 and extend for the entire longitudinal length of the compression plate 414 in the preferred embodiment. The distal edges 514 of each of the substantially vertical walls 512 comprises an interlocking ledge 517, 517'. Each of these interlocking ledges 517, 517' corresponds with an interlocking ledge 516, 516', respectively, on the bottom plate 412. In the preferred embodiment, the compression plate 414 is made from aluminum or some similar rigid material, while the bottom plate 412 is made from a flexible plastic material. Thus, when the compression plate 414 is forced toward the bottom plate 412, the interlocking ledges 516, 516' on the flexible bottom plate 412 snap around the interlocking ledges 517, 517', respectively, on the substantially rigid compression plate 414, thereby locking the two components together as shown in FIGS. 14 and 15, for example.

Figure 16:
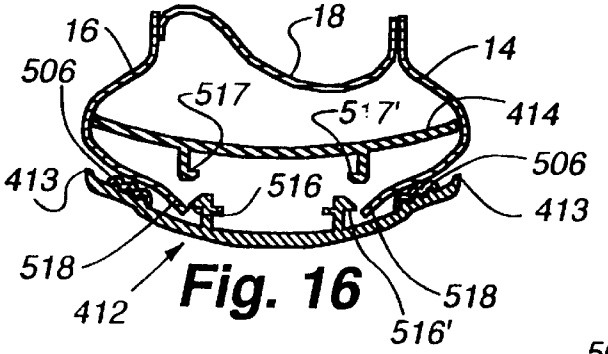
FIG. 16 is an exploded, fragmentary cross-sectional view of the bottom rail depicting how the first and second flexible sheets are attached to the bottom rail.

Referring now to FIG. 16, the assembly of the bottom plate 412, compression plate 414, and the covering 12 is described. As shown in FIG. 16, the first flexible sheet 14 and the second flexible sheet 16 of the covering 12 each has a trailing edge 518 extending below the lowest horizontal vane 18 connecting these two flexible sheets. To attach the bottom rail 20 to the covering 12, the relatively rigid compression plate 414 is placed between the trailing edges 518 of the first and second flexible sheets 14, 16. Then, the bottom plate 412 is pressed toward the compression plate 414 while ensuring that the trailing edges 518 extending past the compression plate 414 are placed on top of the longitudinally extending strips of gripping material 506 affixed along the longitudinal edges 413 of the bottom plate 412. With the trailing edges 518 of the two flexible sheets 14, 16 positioned as shown in FIG. 16, the bottom plate 412 is pressed toward the compression plate 414 until the first and second interlocking ledge pairs 516/517, 516', 517' snap together, as shown in FIG. 15. When the bottom rail 20 has been properly assembled, the trailing edges 518 of the first and second flexible sheets 14, 16 are trapped between the gripping material 506 and the interior surface of the compression plate 414.

Figure 17:
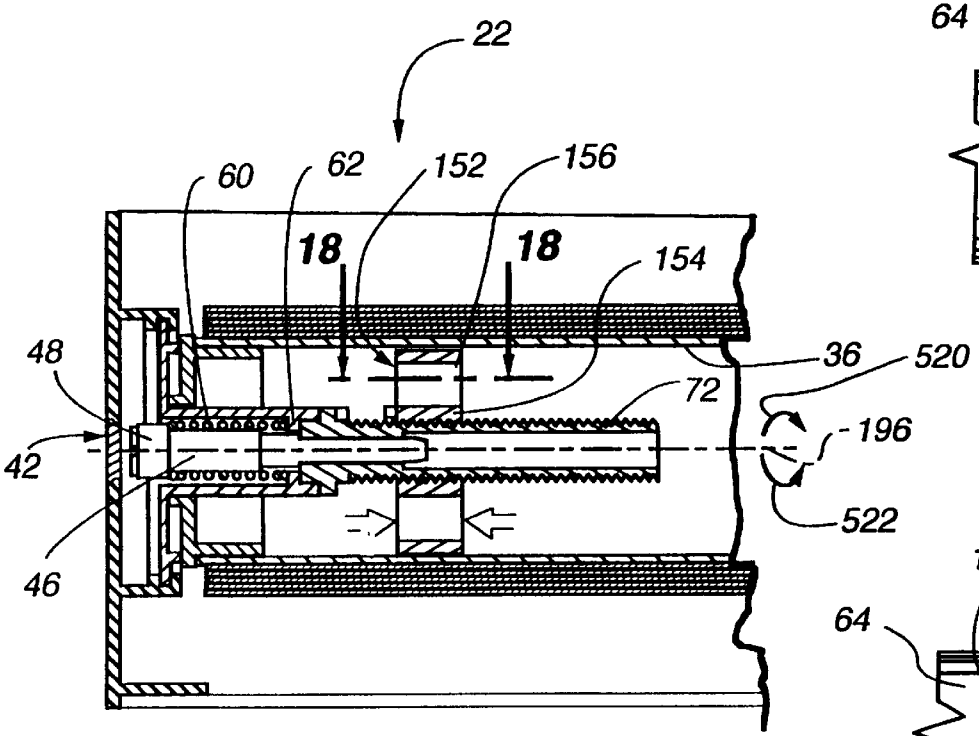
FIG. 17 depicts the control system hardware at the left end of the head rail, showing that the internal, roll bar support wheel moves left and right (as depicted) along the threaded shaft as the covering is extended or retracted.

Referring now to FIGS. 17, 18, 19, 20, and 21, operation and adjustment of the control system hardware that controls the upper retraction limit is next described. FIG. 17 shows a cross section of the left-hand end of the assembled head rail 22. As shown in FIG. 17, the plunger 46 is snapped together with the threaded shaft 72, and the setting retention spring 60 is trapped between the spring retention ring 62 and the underside of the plunger head 48. Tension within the setting retention spring 60 causes the spring to press against the spring retention ring 62 and the plunger head 48, thereby biasing the plunger head 48 toward the left, which simultaneously biases the threaded shaft 72 to the left as depicted in FIG. 17. When the threaded shaft 72 is thus biased to the left, as depicted, this causes the four locking lugs 142 on the head 144 of the threaded shaft 72 (see FIG. 5B) to engage the locking fingers 140 on the distal end of the cylindrical housing 64 of the skew adjustment plate 66 (see FIG. 5A for a clear view of the locking fingers 140). When in this configuration, the threaded shaft 72 is kept from rotating by the pressure between the four locking lugs 142 and the locking fingers 140. Therefore, if the roll bar 36 is rotated in one of the directions indicated by the bent arrows 520, 522 at the right side of FIG. 17, this causes the internal roll-bar-support wheel 152 to move left or right, as depicted in FIG. 17, parallel to the axis of rotation 196 of the roll bar 36. Rotation of the roll bar 36 thus rotates the internal roll-bar-support wheel 152, which must rotate substantially in unison with the roll bar 36 because of the interaction between the alignment tongue 114 and the alignment groove 160 (visible in FIG. 5B) and interaction between the elongated channel 110 and the complimentary channel 162 (also visible in FIG. 5B). Since the internal roll-bar-support wheel 152 comprises a threaded barrel 154 that is threaded on the threaded shaft 72, any rotation of the internal, roll-bar-support wheel 152 results in a proportional longitudinal movement of the internal roll-bar-support wheel 152 as the threaded barrel 154 rotates along the threaded shaft. For example, when the covering 12 is extended (i.e., when the roll bar 36 is rotated in the direction indicated by the arrow 522 in FIG. 17), the internal roll-bar-support wheel 152 is driven toward the right as depicted in FIG. 17. This occurs because in the preferred embodiment, the threaded barrel 154 and the threaded shaft 72 have left-handed threads. Obviously, the length of the threaded shaft 72 is at least partially dependent upon the size of the covering 12 that must be unrolled (i.e., the number of rotations that the internal roll-bar-support wheel 152 will complete during extension of the covering). If the threaded shaft 72 is not sufficiently long, extension of the covering will eventually force the internal roll-bar-support wheel 152 to fall off the right end, as depicted, of the threaded shaft. Of course, one could implant a pin or shaft (not shown) perpendicular to the threaded shaft 72 near its free end in order to prevent the internal roll-bar-support wheel 152 from falling off the right end (as depicted in FIG. 17) of the threaded shaft 72. Such a pin or shaft that stops the lateral or longitudinal movement of the internal roll-bar-support wheel 152 could act as a backup to the gravity lock disclosed herein and described further below.

Figure 18:
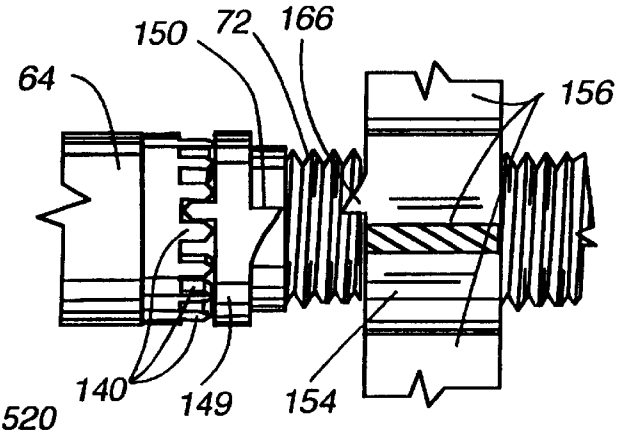
FIG. 18 is an enlarged sectional view of a portion of the control system taken about line 18—18 of FIG. 17.
Figure 19:
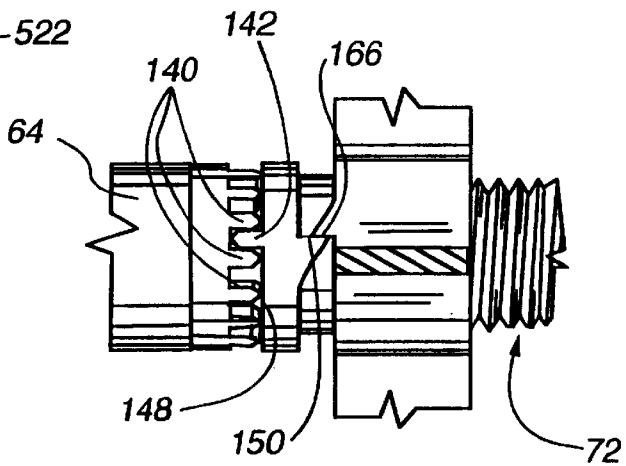
FIG. 19 is a second view of the control system depicted in FIG. 18, depicting abutment of the stopping ledge and the intercepting ledge.

FIGS. 18 and 19 each shows a fragmentary cross-sectional view along line 18—18 of FIG. 17 to demonstrate how the upper stop limit for the covering 12 is set. In FIG. 18, the covering 12 (shown in FIG. 1) is at least partially extended. This is apparent because the intercepting ledge 166 is displaced from the stopping ledge 150 since the internal roll-bar-support wheel 152 is displaced partway down the threaded shaft 72. As the covering 12 is retracted (i.e., the roll bar 12 is rotated in the direction 520 indicated in FIG. 17), the threaded barrel 154 and, thus the internal roll-bar-support wheel 152, moves to the left in FIGS. 18 and 19 until the intercepting ledge 166 on the edge of the threaded barrel 154 intercepts the stopping ledge 150 on the head 144 of the threaded shaft 72. When the intercepting ledge 166 intercepts the stopping ledge 150, no further retraction of the covering 12 may occur. Thus, if the stopping ledge 150 and the intercepting ledge 166 have met, but the covering 12 is not retracted as far as desired, it is necessary to adjust the relative position between the internal roll-bar-support wheel 152 and the threaded shaft 72 to prevent the intercepting ledge 166 from intercepting the stopping ledge 150 until the covering 12 is retracted the desired amount. Adjustment of this relationship between the internal roll-bar-support wheel 152 and the threaded shaft 72 is depicted in FIGS. 20 and 21.

Figure 20:
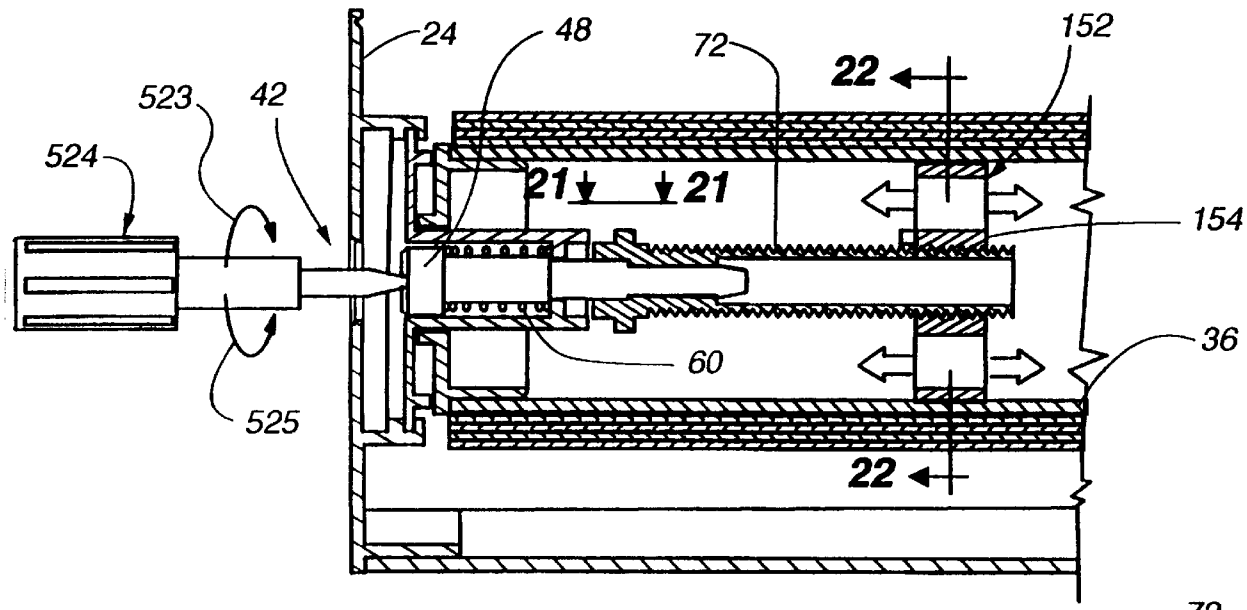
FIG. 20 depicts adjustment of the control system hardware that controls the fully retracted configuration of the covering.
Figure 21:
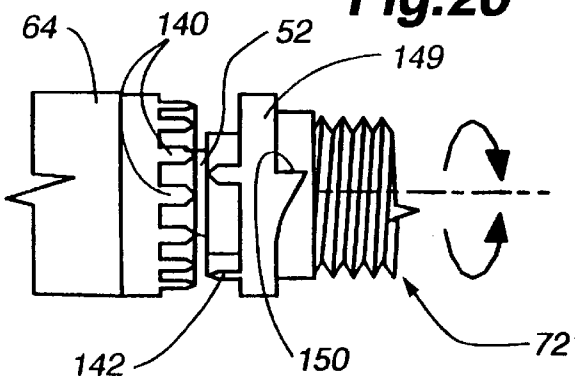
FIG. 21 is an enlarged cross-sectional view of control system hardware taken along line 21—21 of FIG. 20, depicting adjustment of the hardware that controls when during the covering-retraction process the covering is fully retracted.

FIGS. 20 and 21 show adjustment of the relative position of the internal roll-bar-support wheel 152 relative to the threaded shaft 72. Referring first to FIG. 20, a screwdriver 524 is shown inserted in the screwdriver slot 58 (FIG. 5A)

in the plunger head 48. In order to gain access to the screwdriver slot, the access door 32 (visible in FIGS. 1 and 5A) has been removed, and the screwdriver 524 has been inserted through the access port 42 in the left end cap 24. When the screwdriver 524 is forced with sufficient pressure into the screwdriver slot 58 in the plunger head 48, this action compresses the setting retention spring 60 as the plunger 46 travels rightward as depicted in FIG. 20. The plunger 46 and the threaded shaft 72 move in unison because of the interaction among several components, including the intermediate cylindrical portion 52 of the plunger, the interlocking channels 68 on the intermediate cylindrical portion 52, the locking tabs 74 on the flexible arms 56, the interlocking tabs 70 on the interior of the head 144 of the threaded shaft 72, and the annular abutment surface 146 on the left end (as depicted in FIG. 5B) of the threaded shaft 72. Thus, when the plunger 46 is driven rightward in FIG. 20, this simultaneously disengages the locking lugs 142 of the threaded shaft 72 from the interlocking fingers 140 of the cylindrical housing 64 of the skew adjustment plate 66 after the setting retention spring 60 has been compressed a sufficient amount. Once the interlocking lugs 142 are thus disengaged from the locking fingers 140, rotation of the screwdriver 524 directly rotates the threaded shaft 72. Thus, if the roll bar 36 remains motionless, this rotation of the threaded shaft 72 will force the internal roll-bar-support wheel 152 to move left or right, depending upon the direction of rotation of the screwdriver 524. For example, if the screwdriver 524 is rotated in a first direction 523 while the roll bar 36 is kept from moving, the internal roll-bar-support wheel 152 will be pulled to the left in FIG. 20 by the interaction between the threads of the threaded barrel 154 and the threads on the threaded shaft 72. Similarly, if the screwdriver 524 is turned in the second direction 525 while the roll bar 36 is prevented from rotating, the internal roll-bar-support wheel 152 will be pushed to the right in FIG. 20 by the interaction between the threaded barrel 154 and the threaded shaft 72. By making these adjustments, which increase or decrease the number of threads between the left edge of the internal roll-bar-support wheel 152 and the head 144 of the threaded shaft 72, it is possible to adjust the number of rotations that the roll bar 36 is permitted to go through before the intercepting ledge 166 on the internal roll-bar-support wheel 152 intercepts the stopping ledge 150 on the back side of the finger abutment ring 149 on the head 144 of the threaded shaft 72. When the pressure driving the screwdriver 524 rightward in FIG. 20 is released, the setting retention spring 60 drives the plunger 46 and threaded shaft 72 to the left in FIG. 20 until the four locking lugs 142 engage locking fingers 140 on the cylindrical housing 64, and the tips of the locking fingers 140 rest against the finger seat 148 (FIG. 5B) of the finger abutment ring 149. Once the interlocking lugs 142 are locked into the locking fingers 140, the threaded shaft 72 again becomes effectively fixed to the left end cap 24 and, thus, remains stable during rotation of the roll bar 36. FIG. 21 is a fragmentary view taken along line 21—21 of FIG. 20 and depicts disengagement of the locking lugs 142 (two of which are depicted) from the locking fingers 140.

Figure 22:
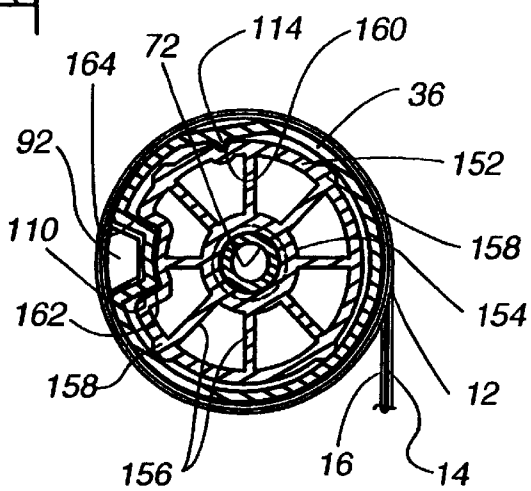
FIG. 22 depicts the internal, roll-bar-support wheel installed in the roll bar, and shows the covering wrapped around the outer surface of the roll bar.

FIG. 22 is a partial cross-sectional view taken along line 22—22 of FIG. 20 through the center of the internal roll-bar-support wheel 152. The threaded barrel 154 of the internal roll-bar-support wheel 152 is shown as threaded onto the threaded shaft 72, the edge of the threads shown in phantom as a ring around the threaded shaft 72. Placement of the internal roll-bar-support wheel 152 within the roll bar 36 is also clearly visible in FIG. 22. The alignment tongue 114 is shown as riding in the alignment groove 160, and the complimentary channel 162 of the internal roll-bar-support wheel 152 is shown accommodating the elongated channel 110 built in to the roll bar 36. The wedge 92 of the down limit stop 88 is also visible riding on the outside of the roll bar 36 in the elongated channel 110. The threaded barrel 154 is supported by a plurality of barrel support spokes 156. Although spokes 156 are used in the preferred embodiment, clearly the spokes 156 could be replaced by solid material or the number of barrel support spokes 156 could be increased or decreased at the whim of the designer. Several layers of the covering 12 are shown as still being wound around the roll bar 36 in FIG. 22, and a portion of the covering 12 has been unwound and is hanging down from the right-hand side, as depicted, in FIG. 22.

Figure 23B:
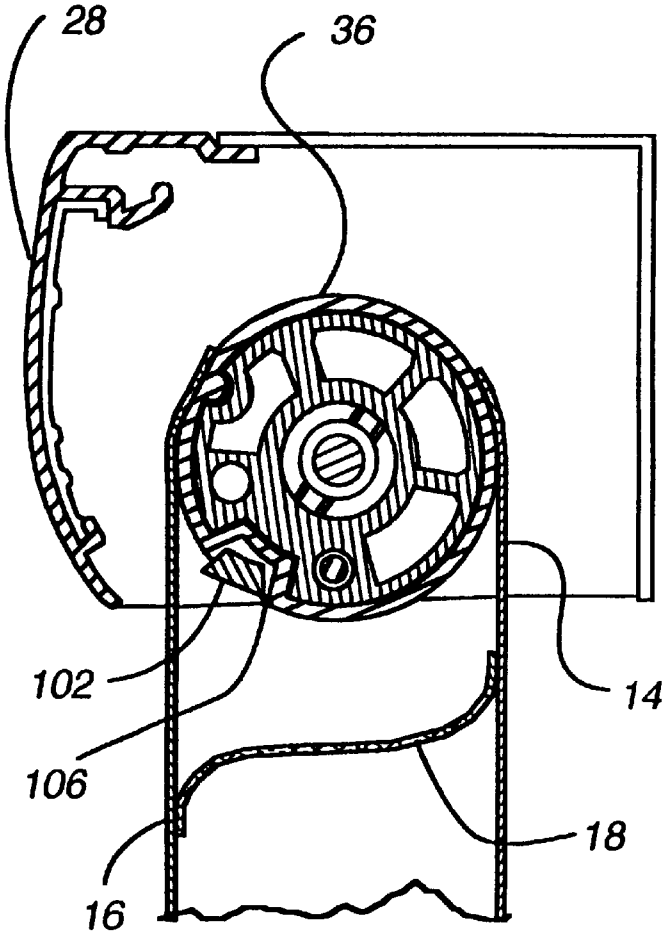
FIG. 23B depicts the head rail components depicted in FIG. 23A, but shows the covering at full extension.
Figure 23A:
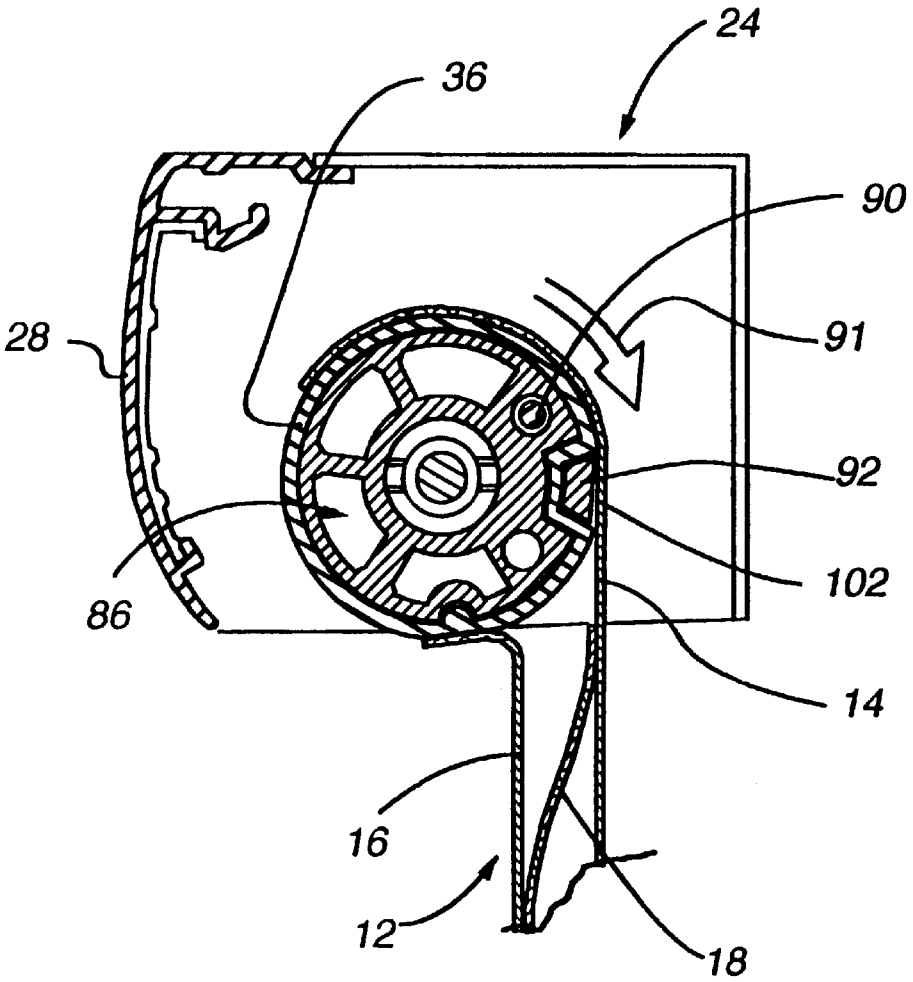
FIG. 23A shows the left end of the head rail in partial cross-section taken along line 23A—23A of FIG. 4, depicting the covering approaching full extension.
Figure 24B:
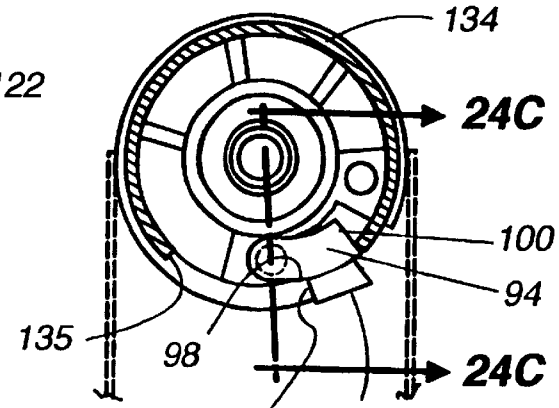
FIG. 24B shows the control system hardware depicted in FIG. 24A after the covering has reached full extension.
Figure 24A:
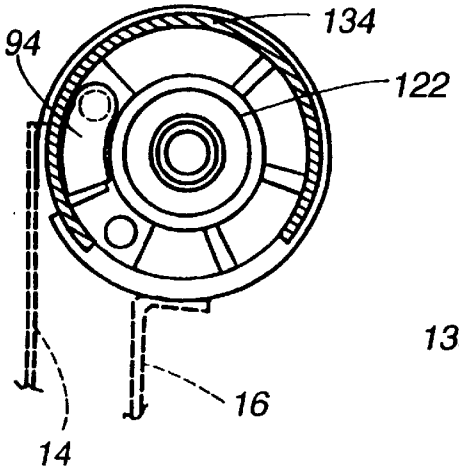
FIG. 24A depicts control system components shown in FIG. 23A in partial cross-section taken along line 24A—24A of FIG. 4 as the covering approaches full extension.

Referring now to FIGS. 23A, 23B, 24A and 24B, operation of the extension limit (gravity lock) in the present invention is described next. FIG. 23A is a fragmentary cross-sectional view taken about line 23A—23A in FIG. 4. Clearly visible in FIG. 23A is the left end cap 24, the arcuate cover plate 28, a portion of the roll bar 36, the roll-bar-end support wheel 86 with the down limit stop 88 (FIG. 5A) mounted thereon, and a portion of the covering 12. As shown by the direction arrow 91 in FIG. 23A, the roll bar 36 is rotating clockwise and extending the covering 12 comprising the first flexible 14, the second flexible sheet 16, and the horizontal vanes 18. As depicted in FIG. 23A, the covering 12 is nearing complete extension. The interior side of the first flexible sheet 14 is pressing against the outer surface 102 of the wedge 92 on the down limit stop 88, thereby keeping the wedge 92 from rotating about its mounting tang 90. FIG. 24A shows the covering and roll bar 36 in approximately the same position from the opposite direction since FIG. 24A is a partial cross-sectional view taken about line 24A—24A in FIG. 4. In FIG. 24A it is clearly visible that the flexible sheet 14 pressing against the outer surface 102 of the wedge 92 is keeping the arcuate arm 94 within the semi-annular channel 124 (see also FIG. 6A) defined between the semi-annular channel wall 134 and the annular bearing surface 122 (FIG. 5A) on the roll-bar-end support wheel 86.

FIG. 23B is similar to FIG. 23A; however, rotation of the roll bar 36 has been stopped by the down limit stop 88 and the covering 12 is in its fully extended configuration. When the roll bar 36 rotates from the position shown in FIG. 23A to that shown in FIG. 23B, no covering material remains on the roll bar 36 to press against the outer surface 102 of the wedge 92 and keep the down limit stop 88 from rotating about the mounting tang 90. Therefore, shortly after being in the position shown in FIG. 23A and shortly before reaching the position shown in FIG. 23B, gravity causes the down limit stop 88 to rotate about its mounting tang 90 to the position shown in FIG. 23B and in FIG. 24B, which shows the same position from the opposite side. With the down limit stop 88 thus rotated, the leading edge 100 of the arcuate arm 94 impacts the edge of the semi-annular channel wall 134 since the arcuate arm 94 of the down limit stop 88 is no longer forced to remain within the semi-annular channel 124 by the pressing of the covering material on the outer surface 102 of the wedge 92. When the leading edge 100 of the arcuate arm 94 impacts the semi-annular channel wall 134, as depicted most clearly in FIG. 23B, the trailing edge 106 of the wedge 92 is simultaneously driven into a side wall 165 of the elongated channel 110 in the roll bar 36. Thereby, any further downward motion of the covering 12 toward the extended position is prevented. When the roll bar 36 is rotated in the opposite direction to that depicted by the direction arrow 91 in FIG. 23A in order to retract the covering 12 by winding it back on to the roll bar 36, the opposite edge 135 (FIG. 24B) of the semi-annular channel wall 134 impacts the outer edge 98 of the arcuate arm 94, thereby rotating the down limit stop 88 counterclockwise as depicted in FIG. 24B about the mounting tang 90 and pushing the arcuate arm 94 back into the semi-annular channel 124 defined between the semi-annular channel wall 134 and the annular bearing surface 122 of the roll-bar-end support wheel 86. Then, as the roll bar 36 continues to retract the covering 12 and completes its first full rotation, the down limit stop 88 is prevented from rotating about its mounting tang 90 since a layer of the covering 12 will then be present to press against the outer surface 102 of the wedge 92 during further retraction of the covering 12.

Figure 24C:
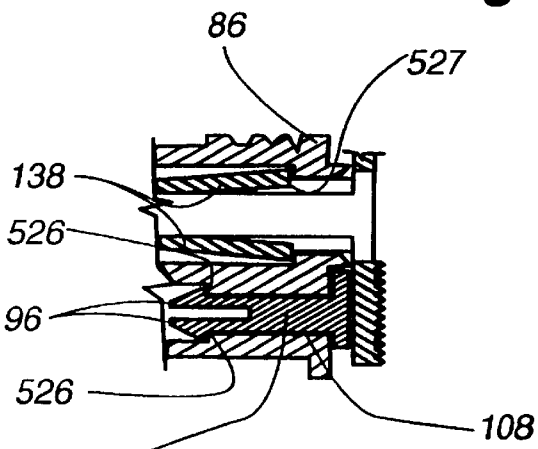
FIG. 24C is a fragmentary cross-sectional view taken about line 24C—24C of FIG. 24B.

FIG. 24C is a fragmentary cross-sectional view taken about line 24C—24C of FIG. 24B. This figure clearly shows how the support wheel locks 138, which in the preferred embodiment is an integral part of the cylindrical housing 64 on the skew adjustment plate 66 (see, e.g., FIG. 6A), snap behind the annular ledge 527 on the inside of the otherwise smooth barrel 118 suspended in the center of the roll-bar-end support wheel 86 by a plurality of spokes 120. When the roll-bar-end support wheel 86 is slid onto the cylindrical housing 64 of the skew adjustment plate 66, the support wheel locks 138 are flexed toward the axis of rotation 196 of the roll-bar-end support wheel 86 until the roll-bar-end support wheel 86 is slid sufficiently far onto the cylindrical housing 64 that the support wheel locks 138 can trap the support wheel 86 onto the cylindrical housing 64 by springing out behind the ledge 527. Also clearly visible in FIG. 24C is the method of attaching the down limit stop 88 to the roll-bar-end support wheel 86. When the mounting tang 90 is pushed sufficiently into the mounting hole 108 on the support wheel 86, the locking tabs 96 on the distal end of the mounting tang 90 snap past a ridge 526 on the inside of the mounting hole 108 where the mounting hole diameter increases slightly.

Figure 25:
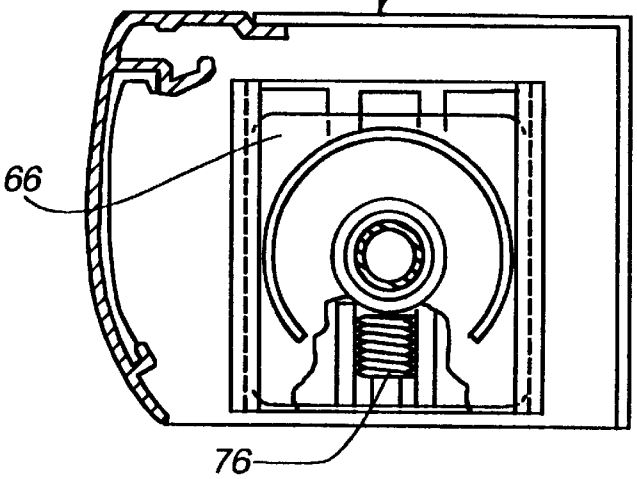
FIG. 25 depicts, in partial cross-section and partially broken out, control system components that facilitate skew adjustment.

Referring next to FIGS. 3B, 5A, 6A, and 25, the control system components that permit one type of skew adjustment available with the present invention are described next. As shown in FIG. 3B, if the left end cap 24 is incorrectly mounted higher than the right end cap 26, for example, a skew angle 528 will be present between an imaginary horizontal line 530 and a second imaginary line 532 extending between the top of the right end cap 26 and the top of the left end cap 24. This skew angle 528 can be compensated for or corrected by turning the threaded skew adjustment plug 76 in the plug bed 78 (FIG. 6A) by inserting a screwdriver 524 (FIG. 3B) through the access hole 80 (most clearly visible in FIG. 6A). When the skew adjustment plug 76 is rotated, the threads on the skew adjustment plug 76, which engage the arcuate threaded surface 84 (FIGS. 5A and 3B), molded into the skew adjustment plate 66, drive the skew adjustment plate 66 upward or downward, depending on the direction of rotation of the skew adjustment plug 76. The skew adjustment plate 66 is capable of moving up and down relative to the left end cap 24 since the front vertical edge 534 and the rear vertical edge 536 (see FIG. 6A) of the skew adjustment plate 66 ride in complimentary channels 82 molded onto the interior surface of the left end cap 24 (FIG. 6). Since the cylindrical housing 64 of the skew adjustment plate 66 moves the axis of rotation of the roll bar 36 via the interaction between the cylindrical housing 64, the roll-bar-end support wheel 86, and the roll bar 36, as the skew adjustment plate 66 is driven upward or downward by rotation of the skew adjustment plug 76, the entire left end (as depicted in FIG. 3B) of the roll bar 36 moves upward or downward. It is thereby possible to position one end of the roll bar 36 relative to the other end of the roll bar 36 without having to move the end caps 24, 26, which may be fixed relative to a mounting surface by mounting brackets 30 (see FIG. 1). FIG. 25 provides a view of the skew adjustment plate 66 in position in the channels molded on the inward surface of the left end cap 24. The skew adjustment plug 76 is pinched between the arcuate threaded surface 84 of the skew adjustment plate 66 and the plug bed 78 (FIG. 6A) of the left end cap 24. The skew adjustment plug 76 is pinched with sufficient pressure that the skew adjustment plate 66 will not move due merely to the weight of the roll bar 36 and covering 12, but the skew adjustment plug 76 is not pinched so hard that desired skew adjustment is difficult to achieve.

Although preferred embodiments of this invention have been described above, those skilled in the art could make numerous alterations to the disclosed embodiments without departing from the spirit or scope of this invention. For example, each of the support wheels 86, 152 could be made with more or fewer spokes or they could be made with no spokes to support the central barrels, whether threaded or unthreaded. Also, in the preferred embodiment, the threaded shaft 72 and the threaded barrel 154 in the internal-roll-bar support wheel 152 are left-hand threaded. If desired, a right-hand thread could be used, but the covering 12 may be required to roll on the roll bar 36 from the opposite side from that depicted in the enclosed drawings, or the control system components that make it possible to control the maximum retraction and maximum extension of the covering could be incorporated into the right-hand end of the head rail 22. In the break away operating cord system depicted in the present application, a single clutch coil spring 172 is shown in FIG. 5B, but more than one clutch coil spring could be incorporated into this portion of the control system without deviating from the scope of the present invention. The applicant has obtained favorable results from using two clutch coil springs. Also, as depicted in the drawings and discussed above, the covering 12 comprises two flexible sheets 14, 16 with a plurality of horizontal vanes 18 extending between them. Any type of roll up covering, however, could be used in conjunction with the control system components of the present invention. It is intended that all matter contained in the above description or shown in the accompanying drawings shall be interpreted as illustrative only and not limiting.

We claim:

1. A control system for a retractable covering, wherein the retractable covering is adapted to extend across an architectural opening and wherein said control system is adapted to manipulate the covering through rotation of an element in the control system, said control system comprising a head rail;

a roll bar rotatably mounted within said head rail; and limiting means inside of said roll bar for mechanically limiting a fully retracted configuration of the covering, wherein said limiting means includes a fixed member a moveable member, and wherein said moveable member moves linearly and contacts said fixed member when the covering is in the fully retracted configuration.

2. The control system of claim 1, wherein said head rail comprises a first end and wherein a first end cap is attached to said first end, and wherein said limiting means further comprises a threaded shaft having a mounting end adjustably fixed to said first end cap;

an internal, roll-bar-support wheel slidably mounted in said roll bar for rotation therewith, said internal roll-bar-support wheel having an internally threaded barrel rotatably mounted on said threaded shaft;

an intercepting ledge comprising part of said internal, roll-bar-support wheel, and a stopping ledge comprising part of said threaded shaft.

3. The control system of claim 2, said adjusting means further comprising means for adjusting a position of said internal, roll-bar-support wheel relative to said threaded shaft for a given configuration of the covering, whereby said fully retracted configuration of the covering is adjustable.

4. The control system of claim 3, wherein said adjustment means further comprises a cylindrical housing mounted to said first end cap, said cylindrical housing having a spring retention ring at a first end thereof;

a setting retention spring, wherein said setting retention spring is accommodated within said cylindrical housing and against said spring retention ring; and a plunger having a plunger head, wherein said plunger is inserted into said cylindrical housing and through said setting retention spring, thereby trapping said setting retention spring between said plunger head and said spring retention ring.

5. The control system of claim 4, wherein said plunger further comprises an attachment end remote from said plunger head, said attachment end passing through said spring retention ring and releasably engaging said threaded shaft.

6. The control system of claim 5, wherein said plunger further comprises at least one interlocking channel, and wherein said threaded shaft further comprises a corresponding interlocking tab that is captured by said at least one interlocking channel.

7. The control system of claim 5, wherein said attachment end of said plunger comprises two flexible arms, wherein a distal end of said two flexible arms lockingly engage said mounting end of said threaded shaft.

8. The control system of claim 7, wherein said cylindrical housing further comprises locking fingers, and wherein said mounting end of threaded shaft includes a plurality of locking lugs, wherein said setting retention spring biases said locking lugs into engagement with said locking fingers.

9. The control system of claim 7, wherein said two flexible arms have locking tabs integrally formed thereon, and wherein said locking tabs removably attach said plunger to said threaded shaft.

10. The control system of claim 9 wherein said plunger head has a screwdriver slot formed therein, and wherein said first end cap has an access port therethrough positioned so that said screwdriver slot is accessible through said access port.

11. A control system for a retractable covering, wherein the retractable covering is adapted to extend across an architectural opening and wherein said control system is adapted to manipulate the covering through rotation of an element in the control system, said control system comprising a head rail;

a roll bar rotatably mounted within said head rail, said roll bar comprising an elongated channel; and limiting means within said head rail for mechanically limiting a fully extended configuration of the covering, said limiting means comprising a roll-bar-end support wheel having a down limit stop pivotally mounted thereto.

12. The control system of claim 11, wherein said roll bar comprises a first end, and wherein said roll-bar-end support wheel is partially inserted into said first end of said roll bar, and further wherein said down limit stop is mounted to said roll-bar-end support wheel such that a first portion of said down limit stop is inside said first end of said roll bar, and a second portion of said down limit stop is outside said roll bar.

13. A control system for a retractable covering, wherein the retractable covering is adapted to extend across an architectural opening and wherein said control system is adapted to manipulate the covering through rotation of an element in the control system, said control system comprising a head rail;

a roll bar rotatably mounted within said head rail;

limiting means within said head rail for mechanically limiting a fully retracted configuration of the covering, wherein said moveable meuser comprises an internal, roll-bar-support wheel having an outer ring that includes an alignment groove, wherein said internal, roll-bar-support wheel is slidably mounted in said roll bar with said alignment tongue riding in said alignment groove whereby said the internal, roll-bar-support wheel and said roll bar rotate substantially in unison.

14. A control system for a retractable covering, wherein the retractable covering is adapted to extend across an architectural opening and wherein said control system is adapted to manipulate the covering through rotation of an element in the control system, said control system comprising a head rail;

a roll bar rotatably mounted within said head rail; and limiting means within said head rail for mechanically limiting a fully extended configuration of the covering, said limiting means comprising a roll-bar-end support wheel having a down limit stop mounted thereto; and wherein said head rail comprises a first end and wherein a first end cap is attached to said first ends and further wherein a substantially annular channel defined by a substantially annular channel wall is associated with said first end cap, and a portion of said down limit stop rides in said annular channel.

15. The control system of claim 14, wherein said portion of said down limit stop comprises an arcuate arm.

16. The control system of claim 15, wherein said roll-bar-end support wheel includes a mounting hole, and wherein said down limit stop further comprises a mounting tang for pivotally mounting said down limit stop to said mounting hole of said roll-bar-end support wheel and a wedge, wherein said arcuate arm connects said mounting tang with said wedge.

17. The control system of claim 16, wherein said mounting tang comprises a distal end, wherein said distal end is split, and a locking tab extending from each of said split ends, wherein said locking tabs on said distal end of said mounting tang rotatably lock said down limit stop to said roll-bar-end support wheel.

18. The control system of claim 17, wherein said arcuate arm includes an arcuate outer edge and a substantially flat leading edge.

19. The control system of claim 18, wherein said wedge includes an outer surface, a leading edge, and a trailing edge.

20. The control system of claim 19, wherein said roll bar comprises an elongated channel, and wherein, when said roll-bar-end support wheel is installed in said roll bar, said wedge rides in said elongated channel of said roll bar.

21. The control system of claim 20, wherein said roll bar comprises an alignment tongue, and wherein said roll-bar-end support wheel comprises an alignment groove in which said alignment tongue rides, thereby forcing said roll-bar-end support wheel to rotate with said roll bar.

22. The control system of claim 21, wherein said roll-bar-end support wheel is mounted to said first end cap for rotation relative thereto.

23. A retractable covering in combination with a control system therefor, wherein said covering comprises at least a first flexible sheet, wherein said retractable covering is adapted to extend across an architectural opening, and wherein said control system manipulates said covering through rotation of an element in said control system, said combination comprising a head rail;

a roll bar rotatably mounted within said head rail, wherein said retractable covering is adapted to roll on and unroll from said roll bar; and limiting means within said head rail for mechanically limiting a fully extended configuration of said covering, said limiting means comprising a roll-bar-end support wheel having a down limit stop mounted thereto;

wherein said head rail comprises a first end and wherein a first end cap is attached to said first end, and further wherein a substantially annular channel defined by a substantially annular channel wall is associated with said first end cap, and an arcuate arm comprising a portion of said down limit stop rides in said annular channel;

wherein said roll-bar-end support wheel includes a mounting hole, and wherein said down limit stop further comprises a mounting tang for pivotally mounting said down limit stop to said mounting hole of said roll-bar-end support wheel and a wedge, wherein said arcuate arm connects said mounting tang with said wedge; and wherein a portion of said first flexible sheet presses against said wedge and thereby keeps said arcuate arm in said annular channel while said covering is rolled on said roll bar.

24. The combination of claim 23, wherein, when said covering is unrolled from said roll bar, said down limit stop rotates about said mounting tang and impacts at least one of said channel wall and said roll bar.

25. A retractable covering in combination with a control system therefor, wherein said covering comprises at least a first flexible sheet, wherein said retractable covering is adapted to extend across an architectural opening, and wherein said control system manipulates said covering through rotation of an element in said control system, said combination comprising a head rail;

a roll bar rotatably mounted within said head rail, wherein said retractable covering is adapted to roll on and unroll from said roll bar, and limiting means within said head rail for mechanically limiting a fully extended configuration of said covering, said limiting means comprising a roll-bar-end support wheel having a down limit stop mounted thereto;

wherein said roll bar comprises a first end, and wherein said roll-bar-end support wheel is partially inserted into said first end of said roll bar, and further wherein said down limit stop is mounted to said roll-bar-end support wheel such that a first portion of said down limit stop is inside said first end of said roll bar, and a second portion of said down limit stop is outside said roll bar; and wherein said roll bar further comprises an elongated channel, and wherein said second portion of said down limit stop is adapted to be pressed by said first flexible sheet into said elongated channel as long as said covering is rolled on said roll bar.

26. The combination of claim 25, wherein said roll-bar-end support wheel includes a mounting hole, wherein said down limit stop further comprises a wedge and a mounting tang for pivotally mounting said down limit stop to said mounting hole of said roll-bar-end support wheel, and wherein said second portion of said down limit stop comprises said wedge, whereby, when said covering is unrolled from said roll bar, said down limit stop rotates about said mounting tang, freeing said wedge from said elongated channel.

* * * * *

UNITED STATES PATENT AND TRADEMARK OFFICE

CERTIFICATE OF CORRECTION

PATENT NO. : 6,289,964 B1
DATED : September 18, 2001
INVENTOR(S) : Wendell B. Colson and Brian M. Hoffmann It is certified that error appears in the above-identified patent and that said Letters Patent is hereby corrected as shown below:

Column 16,
Line 55, after "member" insert -- , --.
Line 56, after "member," insert -- and adjusting means for adjusting a position of said moveable member relative to said fixed member for a given configuration of the covering, whereby the fully retracted configuration of the covering is adjustable, --.
Line 64, after "shaft" insert -- , said threaded shaft being part of said fixed member and --.
Line 65, after "thereto" delete "." and insert -- , said down limit stop adapted to pivot into and out of engagement with said elongated channel. --.
Line 66, after "wheel" insert -- , said internal, roll-bar-support wheel being part of said moveable member and being --.

Column 17,
Line 14, after "rail" insert -- , said roll bar having an inner surface that includes a longitudinally extending alignment tongue --.

Column 18,
Line 16, after "covering," insert -- wherein said limiting means includes a fixed member, a moveable member, and adjusting means for adjusting a position of said moveable member relative to said fixed member for a given configuration of the covering, whereby the fully retracted configuration of the covering is adjustable, and --.
Line 17, delete "meuser" an insert -- member --.
Line 22, after "said" delete "the".
Line 37, after "ends" insert -- , --.

Signed and Sealed this

Twenty-seventh Day of May, 2003

JAMES E. ROGAN
*Director of the United States Patent and Trademark Office*